US008417167B2

(12) United States Patent
Arikawa et al.

(10) Patent No.: US 8,417,167 B2
(45) Date of Patent: Apr. 9, 2013

(54) FIXING DEVICE AND IMAGE FORMING DEVICE

(75) Inventors: Kiichirou Arikawa, Kanagawa (JP); Shigeru Watanabe, Kanagawa (JP); Yasutaka Gotoh, Kanagawa (JP); Hiroko Furukata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 314 days.

(21) Appl. No.: 12/882,799

(22) Filed: Sep. 15, 2010

(65) Prior Publication Data

US 2011/0236069 A1 Sep. 29, 2011

(30) Foreign Application Priority Data

Mar. 24, 2010 (JP) ..... 2010-067416

(51) Int. Cl.
*G03G 15/20* (2006.01)

(52) U.S. Cl.
USPC ..... 399/322; 399/45; 399/122; 399/328

(58) Field of Classification Search ..... 399/322, 399/320, 328, 329, 45, 122
See application file for complete search history.

(56) References Cited

U.S. PATENT DOCUMENTS

| | | | | |
|---|---|---|---|---|
| 5,708,926 | A * | 1/1998 | Sagara et al. | 399/122 |
| 5,956,554 | A * | 9/1999 | Yanashima et al. | 399/328 |
| 2011/0052277 | A1 * | 3/2011 | Ueno et al. | 399/328 |

FOREIGN PATENT DOCUMENTS

| | | | |
|---|---|---|---|
| JP | 08-146812 | A | 6/1996 |
| JP | 08-254913 | A * | 10/1996 |
| JP | 10-177314 | A * | 6/1998 |
| JP | 2006-3695 | A | 1/2006 |
| JP | 2007-086424 | A * | 4/2007 |
| JP | 2008-233245 | A | 10/2008 |

* cited by examiner

*Primary Examiner* — Sophia S Chen
(74) *Attorney, Agent, or Firm* — Sughrue Mion, PLLC

(57) ABSTRACT

A fixing device includes: a fixing rotating member; a pressing rotating member pressed to the fixing surface of the fixing rotating member; a displacing mechanism that can displace the pressing rotating member at least at a first setting position that the pressing rotating member pressed to the fixing surface is located in a first position relative to the fixing rotating member and at a second setting position the pressing rotating member pressed to the fixing surface is in a second position shifted from the first position in the downstream or upstream side of a passing direction of the recording medium at the fixing process part; a guide member having a guide part that guides the recording medium to an introducing portion of the fixing process part; an adjusting mechanism that can adjust the position of the guide member in accordance with the displacement of the pressing rotating member to the first setting position or the second setting position.

6 Claims, 19 Drawing Sheets

FIXING DEVICE AND IMAGE FORMING DEVICE

CROSS-REFERENCE TO RELATED APPLICATION

This application is based on and claims priority under 35 USC 119 from Japanese Patent Application No. 2010-067416 filed on Mar. 24, 2010.

BACKGROUND

1. Technical Field

The present invention relates to a fixing device and an image forming device.

2. Related Art

In an image forming device such as a printer, a copying machine for forming an image composed of a developer on a recording medium such as a sheet, or the like, a fixing device is used by which an unfixed image is fixed on the recording medium. As the fixing device, a device is provided that includes a fixing rotating member having a roll form, a pressing rotating member having a roll form which forms a fixing process part (a pressure contact part) that comes into contact with the fixing rotating member to allow a recording medium holding an unfixed image to pass and a guide member for guiding the recording medium to an introducing port of the fixing process part. In such types of fixing devices, a certain fixing device employs a structure in which a part of the pressing rotating member that comes into contact with the fixing rotating member is displaced depending on the kind of the recording medium (including a difference of thickness) to change a state of the fixing process part and adjust a state of the guide member at the same time. As the fixing device of the above-described type, fixing devices as exemplified below are known.

SUMMARY

According to an aspect of the invention, a fixing device includes:

a fixing rotating member having a fixing surface with which a recording medium holding an unfixed image comes into contact;

a pressing rotating member pressed to the fixing surface of the fixing rotating member to form a fixing process part between the pressing rotating member and the fixing surface through which the recording medium to pass;

a displacing mechanism that can displace the pressing rotating member at least at a first setting position that the pressing rotating member pressed to the fixing surface is located in a first position relative to the fixing rotating member and at a second setting position that the pressing rotating member pressed to the fixing surface is in a second position shifted from the first position in the downstream side or the upstream side of a passing direction of the recording medium at the fixing process part;

a guide member having a guide part that guides the recording medium to an introducing portion of the fixing process part between the fixing rotating member and the pressing rotating member;

an adjusting mechanism that can adjust the position of the guide member in accordance with the displacement of the pressing rotating member at least to the first setting position or the second setting position by the displacing mechanism, wherein the adjusting mechanism adjusts an end of the guide part in the guide member near to the fixing process part to be located in a first state in which the end of the guide part is located at a position closer to the fixing surface of the fixing rotating member than to the surface of the pressing rotating member and a prescribed space separated from the introducing area of the fixing process part or in a second state in which the end of the guide part is located at a position closer to the surface of the pressing rotating member than to the fixing surface of fixing rotating member and nearer to the introducing portion of the fixing process part than in the first state.

BRIEF DESCRIPTION OF THE DRAWINGS

Embodiments of the invention will be described in detail based on the following figures, wherein.

DETAILED DESCRIPTION

Now, a mode for carrying out the invention (refer it simply to as an "exemplary embodiment" hereinafter) will be described by referring to the attached drawings.

First Exemplary Embodiment

Figure 1:
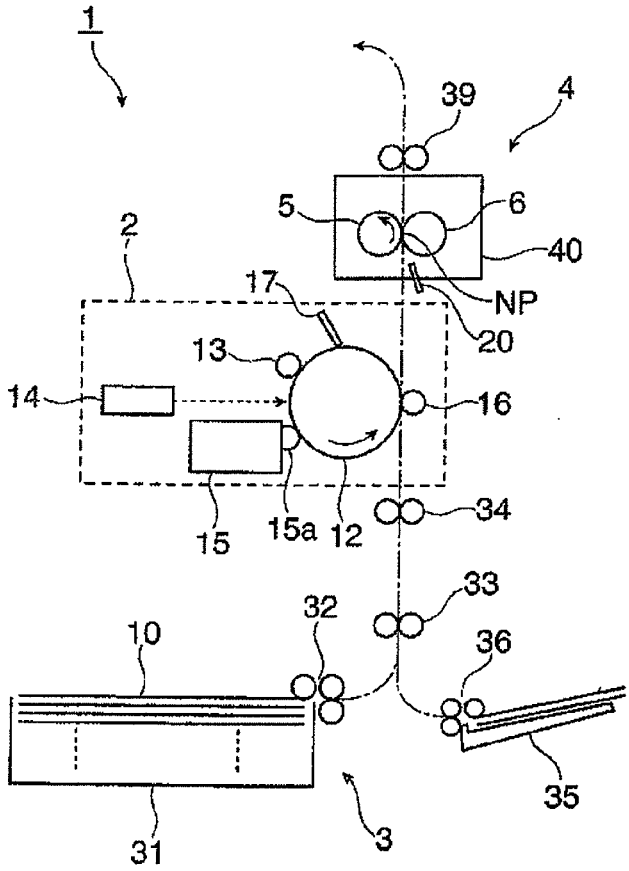
FIG. 1 is a schematic explanatory view showing an image forming device provided with a fixing device according to a first exemplary embodiment.

FIG. 1 shows an image forming device 1 having a fixing device according to a first exemplary embodiment of the present invention.

The image forming device 1 includes, in an inner part of a casing not shown in the drawing, an image creating device 2 for forming an unfixed toner image based on image information and finally transferring the toner image to a recording medium 10 such as a sheet, a sheet supplying device 3 for accommodating the recording medium 10 and transporting and supplying the recording medium to the image creating device 2 and a fixing device 4 for fixing the toner image transferred in the image creating device 2 to the recording medium 10. A dashed line with an arrow mark in the drawing shows a main transporting passage of the recording medium 10.

The image creating device 2 may form and transfer the toner image by using, for instance, a well-known electrophotographic system. Specifically, the image creating device 2 includes a photosensitive drum 12 rotating in a direction shown by an arrow mark. In the periphery of the photosensitive drum 12, are mainly arranged a charging device 13 for charging a surface (an image holding surface) of the photosensitive drum 12, an exposure device 14 for applying a light based on the image information (a signal) to the charged surface of the photosensitive drum 12 to form an electrostatic latent image having a potential difference, a developing device 15 for developing the electrostatic latent image on the photosensitive drum 12 by toner as a developer to form a toner image, a transfer device 16 for transferring the toner image to the recording medium 10 supplied form the sheet supplying device 3 and a cleaning device 17 for removing the toner remaining on the surface of the photosensitive drum 12 after the transfer of the toner image to clean the photosensitive drum.

For instance, as the photosensitive drum 12, on a cylindrical base member, the image holding surface having a photoconductive layer (a photosensitive layer) made of an organic photosensitive material is formed. As the charging device 13, a contact charging system is used in which a prescribed charging voltage is applied to a charging roll rotating in contact with the surface of the photosensitive drum 12 to charge the surface of the photosensitive drum 12. As the exposure device 14, is used an exposure device formed with an LED (a light emitting diode) type recording head, or a semiconductor laser scanning device. To the exposure device 14, an image signal is inputted which is obtained after the image information inputted from an image reading device or a recording medium reading device provided in or connected (wired or wireless connection) to the image forming device 1 or an external device as an image creator such as a computer is subjected to a prescribed process in an image processor not shown in the drawing.

Further, as the developing device 15, a developing device is used in which under a state that the developer (a one-component developer, a two-component developer or the like) including the toner of a prescribed color is charged, the developer is supplied to the surface of the photosensitive drum 12 through a developing roll 15*a* to which a developing voltage is applied. As the transfer device 16, a contact type transfer device is used in which a prescribed transfer voltage is applied to a transfer roll rotating in contact with the surface of the photosensitive drum 12 to carry out a transfer operation.

The sheet supplying device 3 mainly includes an accommodation cassette 31 for accommodating, in a stacked state, plural of recording media 10 of a prescribed size to be supplied to the image creating device 2 and a supply device 32 for supplying and transporting one sheet by one sheet of the recording media 10 accommodated in the accommodation cassette 31. Plural of accommodation cassettes 31 may be provided as required. Further, the sheet supplying device 3 is connected to a sheet transporting passage for supplying the sheet which is composed of plural of pairs of transporting rolls 33, 34 for transporting the recording medium 10 from the accommodation cassette 31 to a transfer part (a part between the photosensitive drum 12 and the transfer device 16) of the image creating device 2 or a transporting and guide member. The pair of sheet transporting rolls 34 is formed as a pair of transporting time adjusting rolls that temporarily stop an end part of the transported recording medium 10, and then, drive the recording medium to be supplied when a prescribed sheet supply timing comes. The sheet transporting passage is also installed between the image creating device 2 and the fixing device 4.

The fixing device 4 includes, in an inner part of a casing 40, a fixing rotating member 5 having a surface temperature heated by a heating unit so as to be held at a prescribed temperature and rotating in a direction shown by an arrow mark, a pressing rotating member 6 pressed to a surface part extending substantially along the direction A of a rotating axis of the fixing rotating member 5 to form a pressure contract part (a fixing process part) NP that allows an object to be fixed (the recording medium 10 to which the toner image is transferred) and a guide plate 20 having a guide part 21*a* for guiding the recording medium 10 as the object to be fixed to an introducing port Unpin (FIG. 7) of the pressure contact part NP. Reference numeral 39 in FIG. 1 designates a pair of feeding rolls for delivering and transporting the recording medium 10 on which the toner image is fixed to a feeding and accommodation part. A detail of the fixing device 4 will be described below.

An image is formed by the image forming device 1 in such a manner as described below.

Initially, in the image creating device 2, the photosensitive drum 12 starts to rotate. After the surface of the rotating photosensitive drum 12 is charged to prescribed charging potential by the charging device 13, the light based on the image signal is applied to the charged surface of the photosensitive drum 12 from the exposure device 14 to form the electrostatic latent image having a prescribed latent image potential. Subsequently, when the electrostatic latent image moves and passes the developing device 15 in accordance with the rotation of the photosensitive drum 12, the toner supplied from the developing roll 15*a* of the developing device 15 electro-statically adheres to a latent image part to develop the latent image as the toner image. After that, the toner image on the photosensitive drum 12 is electro-statically transferred to the recording medium 10 supplied and transported from the sheet supplying device 3 at a transfer position opposed to the transfer device 16. After the transfer of the toner image is finished, the surface of the photosensitive drum 12 is cleaned by the cleaning device 17.

Then, the recording medium 10 on which an unfixed toner image is formed in the image creating device 2 is transported to the fixing device 4, guided by the guide plate 20 and introduced to the pressure contact part NP between a heating roll 50 and an endless belt 60. Thus, in the fixing device 4, the recording medium 10 is transported to pass under a state that the recording medium 10 is held by the pressure contact part NP between a fixing rotating member 5 and a pressing rotating member 6. At that time, the unfixed toner image is pressurized and heated to be fixed to the recording medium 10. The recording medium 10 on which the toner image is fixed is delivered from the fixing device 4, then transported by the pair of feeding rolls 39 and sent to the feeding and accommodation part not shown in the drawing. Thus, the image composed of the toner is formed on one surface of the recording medium 10.

The image forming device 1 may use an envelope shaped material having a bag form such as an envelope as well as a sheet shaped material such as a recording sheet, a thick sheet, a transparent sheet, etc. as the recording medium 10 as an object on which the image is formed. The envelope shaped recording medium 10 is accommodated in the accommodation cassette 31 of the sheet supplying device 3 and transported to the transfer position of the image creating device 2 through the sheet transporting passage for supplying the sheet during the formation of the image, or accommodated in a manual supplying accommodation base 35 as shown in FIG. 1 and joined in the sheet transporting passage for supplying the sheet by a supply device 36 during the formation of the image and transported to the transfer position of the image creating device 2.

Now, a detail of the fixing device 4 will be described below.

Figure 2:
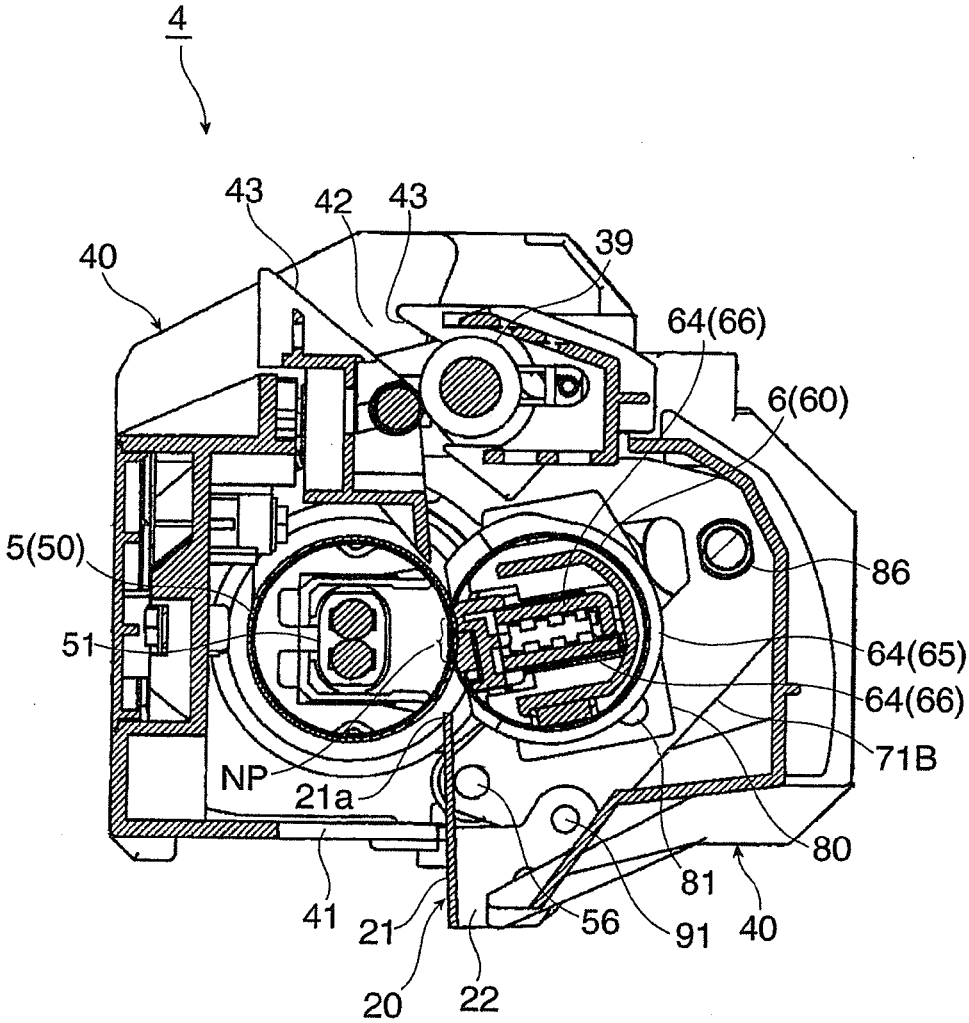
FIG. 2 is a sectional view of the fixing device used in the image forming device shown in FIG. 1.

The fixing device 4 includes, as shown FIGS. 2 to 11, a displacing mechanism 7 for displacing a contact part of the pressurizing rotating member 6 and the heating rotating member 5 and an adjusting mechanism 9 for adjusting the guide plate 20 to a desired state in accordance withy the displacing operation of the displacing mechanism 7 in addition to the heating rotating member 5 and the pressurizing rotating member 6. In FIG. 2, reference numeral 41 designates a taking-in port formed so that the recording medium 10 as an object on which the toner image is fixed may be taken in the casing 40. Reference numeral 42 is a feeding port formed so that the recording medium 10 on which the toner image is completely fixed may be delivered. Reference numeral 43 designates a feeding guide having a rib form for guiding the recording medium 10 delivered from the feeding port 42.

The fixing rotating member 5 is formed as the heating roll 50 having a structure that a cylindrical base material made of metal having a length of a dimension larger than a maximum transporting width of the recording medium 10 as an object to be fixed and an elastic layer and a mold releasing layer are formed in order on the surface of the cylindrical base material. A peripheral surface of the heating roll 50 serves as a fixing surface used for a fixing operation. In the cylindrical base material of the heating roll 50, a heating device 51 for heating the heating roll 50 to a prescribed temperature is arranged. The heating roll 50 is supported by fixing frames 53 at both end parts thereof so as to freely rotate.

Figure 3:
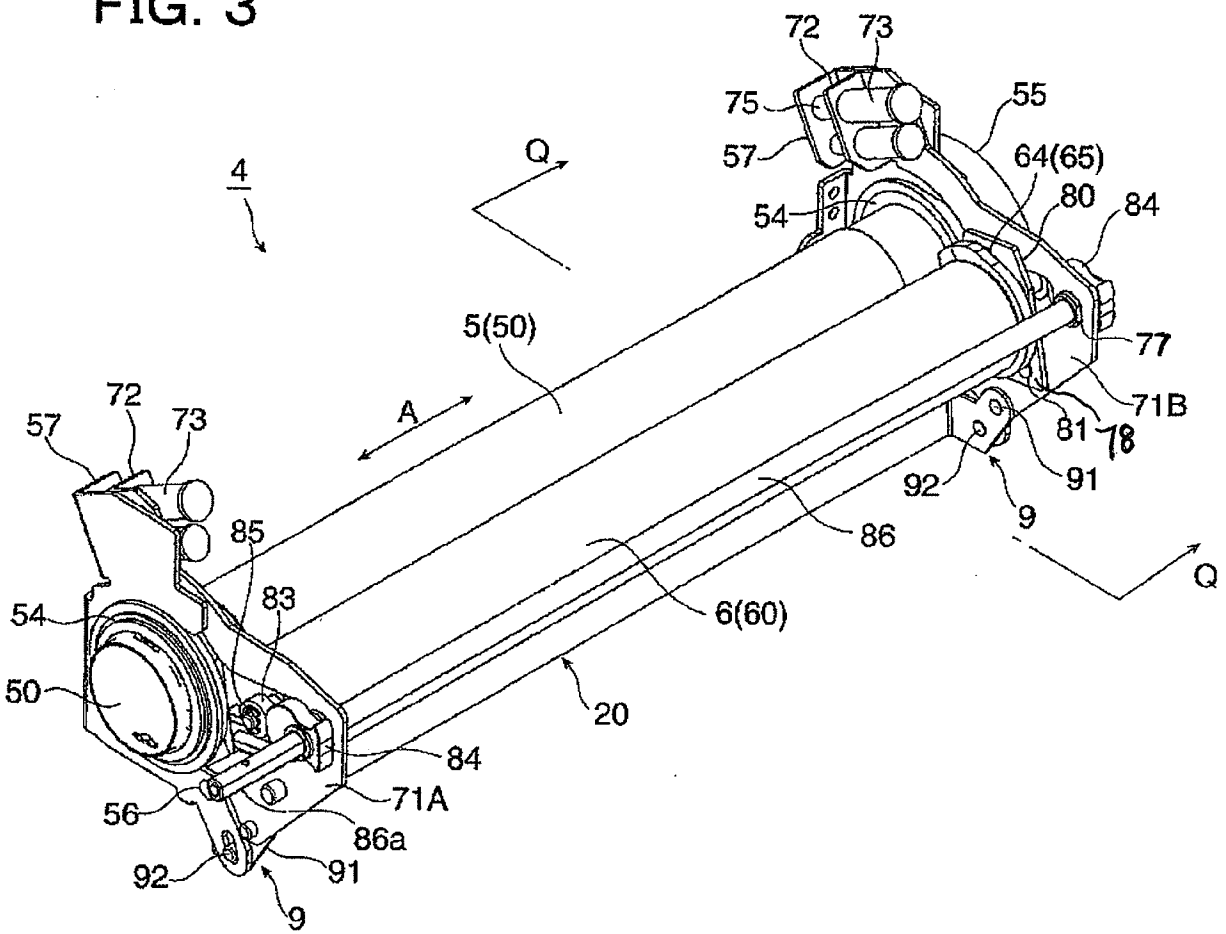
FIG. 3 is a perspective view showing a main part of the fixing device shown in FIG. 2.

The heating roll 50 as the fixing rotating member 5 is, as shown in FIG. 3, attached to the support frames 53 at both end parts thereof through bearings 54. When a rotating power is transmitted to a gear 55 attached to one end part of the roll from a rotating and driving device arranged in a main body side of the image forming device 1, the heating roll 50 is rotated and driven at a prescribed speed. Further, in the heating roll 50, the temperature of the surface of the roll is detected by a temperature detector not shown in the thawing. A heating operation of the heating device 51 is controlled in accordance with the detected information to maintain the temperature of the surface of the roll to a prescribed temperature.

In an inner surface side of a part 53*a* as an introducing side of the recording medium 10 with the pressure contact part NP between the heating roll 50 and the pressing rotating member 6 (the endless belt 60 in this exemplary embodiment) sandwiched by the fixing frames 53, a first shaft 56 is provided. Further, in a part 53*b* as a feeding side of the recording medium 10 with the pressure contact part NP sandwiched by the fixing frames 53, spring support surface parts 57 are formed which are combined with a pressurizing mechanism 45 and used. The spring support surface parts 57 are bent inside the support frames 53. The fixing frames 53 are attached to the casing 40 of the fixing device 4 under a state that the fixing frames 53 are fixed thereto.

The pressing rotating member 6 includes the endless belt 60 rotating in contact with a surface part extending along the direction A (FIG. 3) of a rotating axis of the heating roll 50, a pressing member 61 that presses the endless belt 60 to the peripheral surface (the fixing surface) of the heating roll 50 from its inner peripheral surface side to form the pressure contact part NP and a pressing and support member 64 that supports the endless belt 60 so as to freely rotate and supports a pressing member 62. Namely, the pressing rotating member is formed as a pressing and rotating belt.

The endless belt 60 is a cylindrical belt having a width of substantially the same dimension as that of the length (a dimension in the axial direction) of the heating roll 50. As the endless belt 60, an endless belt is used that is obtained by forming a mold releasing layer made of a fluorine resin on the surface of a belt base material formed in a thin cylindrical shape with a synthetic resin such as polyimide.

Figure 4:
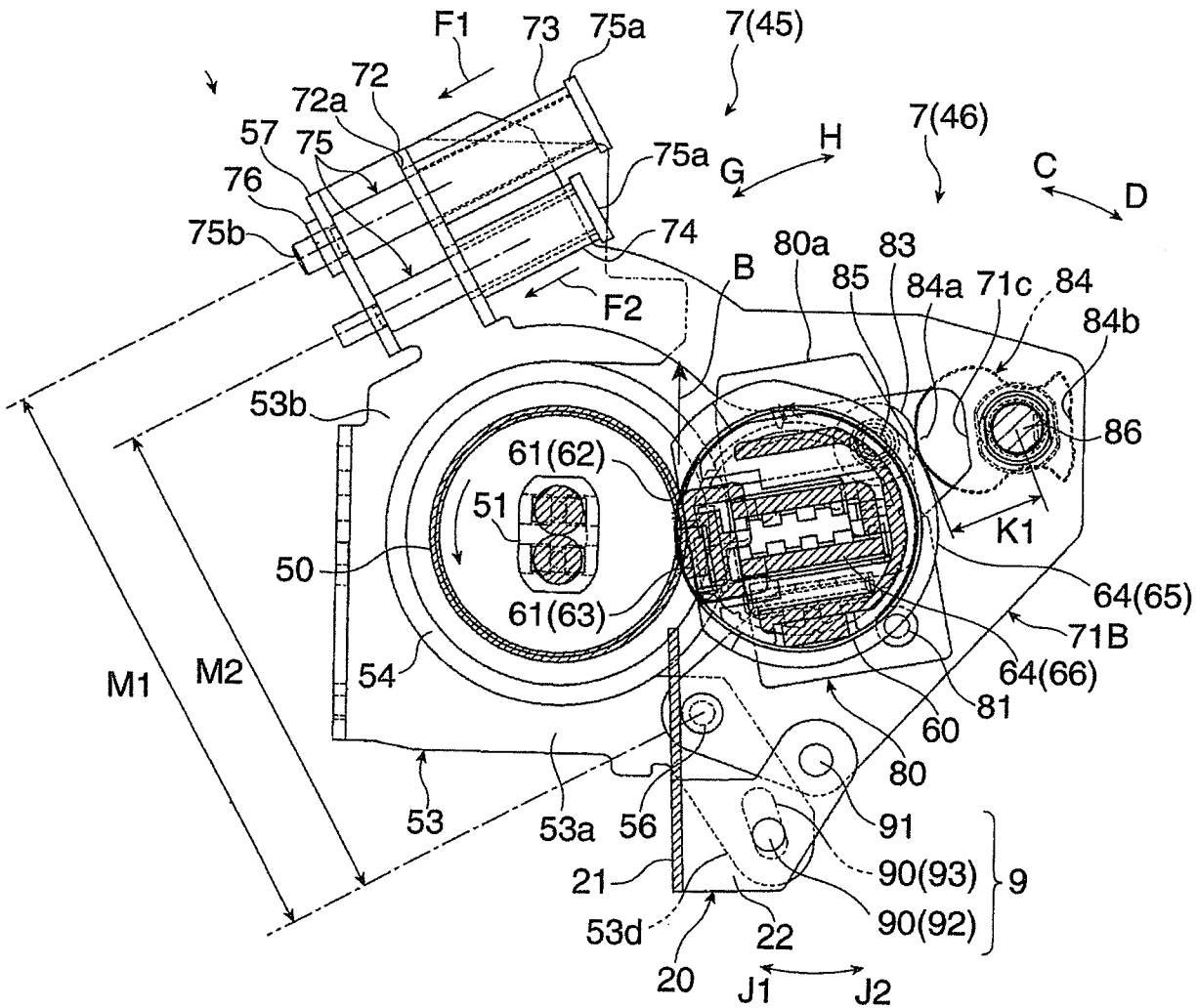
FIG. 4 is a partly sectional view taken along a line Q-Q of the fixing device shown in FIG. 3.
Figure 8:
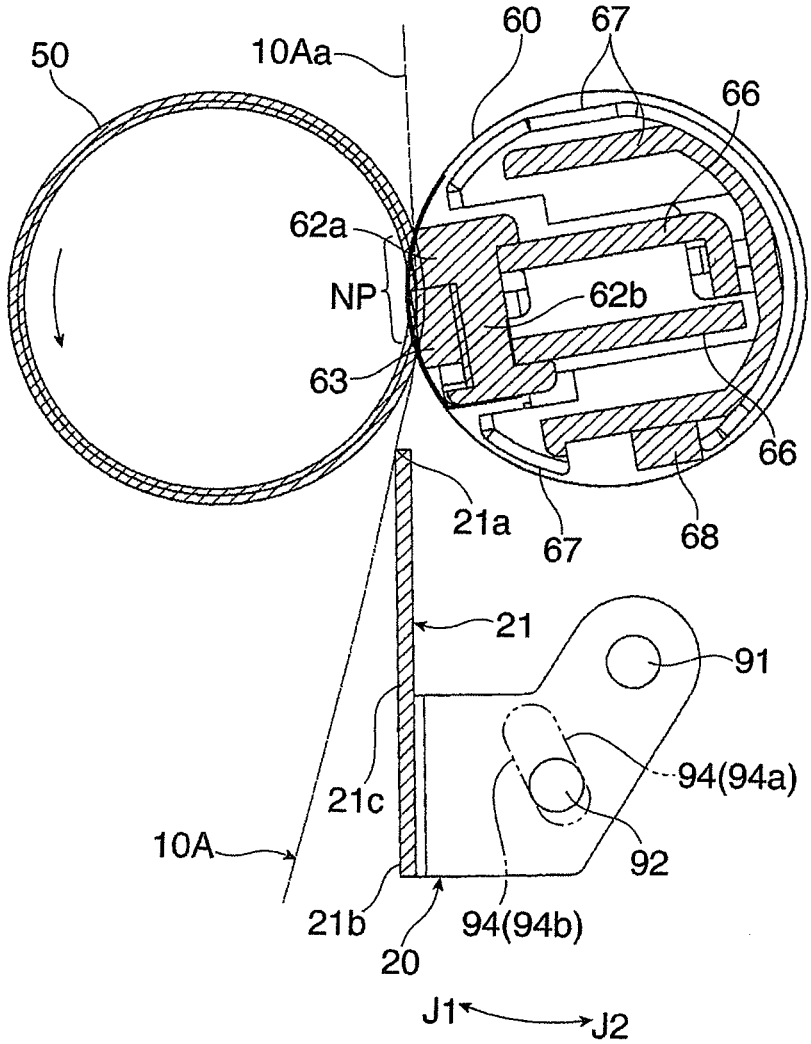
FIG. 8 is a sectional view showing a state of a main part of the fixing device shown in FIG. 4 during an ordinary mode.

As shown in FIG. 4, the pressing member 61 includes a head member 62 and a pad member 63 having elongated forms with substantially the same length as the width of the endless belt 60. The head member 62 is formed with an inelastic member made of a synthetic resin, metal or the like. The head member 62 in the first exemplary embodiment is formed in a configuration including a protruding part 62*a* located in the recording medium feeding side of the pressure contact part NP to allow the endless belt 60 to come into contact with the surface of the heating roll 50 under pressure and a pad holding part 62*b* located in the recording medium introducing side of the pressure contact part NP to hold the pad member 63 (FIG. 8). The pad member 63 is formed with an elastic member made of a rubber material. The pad member 63 in the first exemplary embodiment is formed in an elongated plate shape (a sectional form under a state of no load: a rectangular form) by using silicon rubber.

Figure 7:
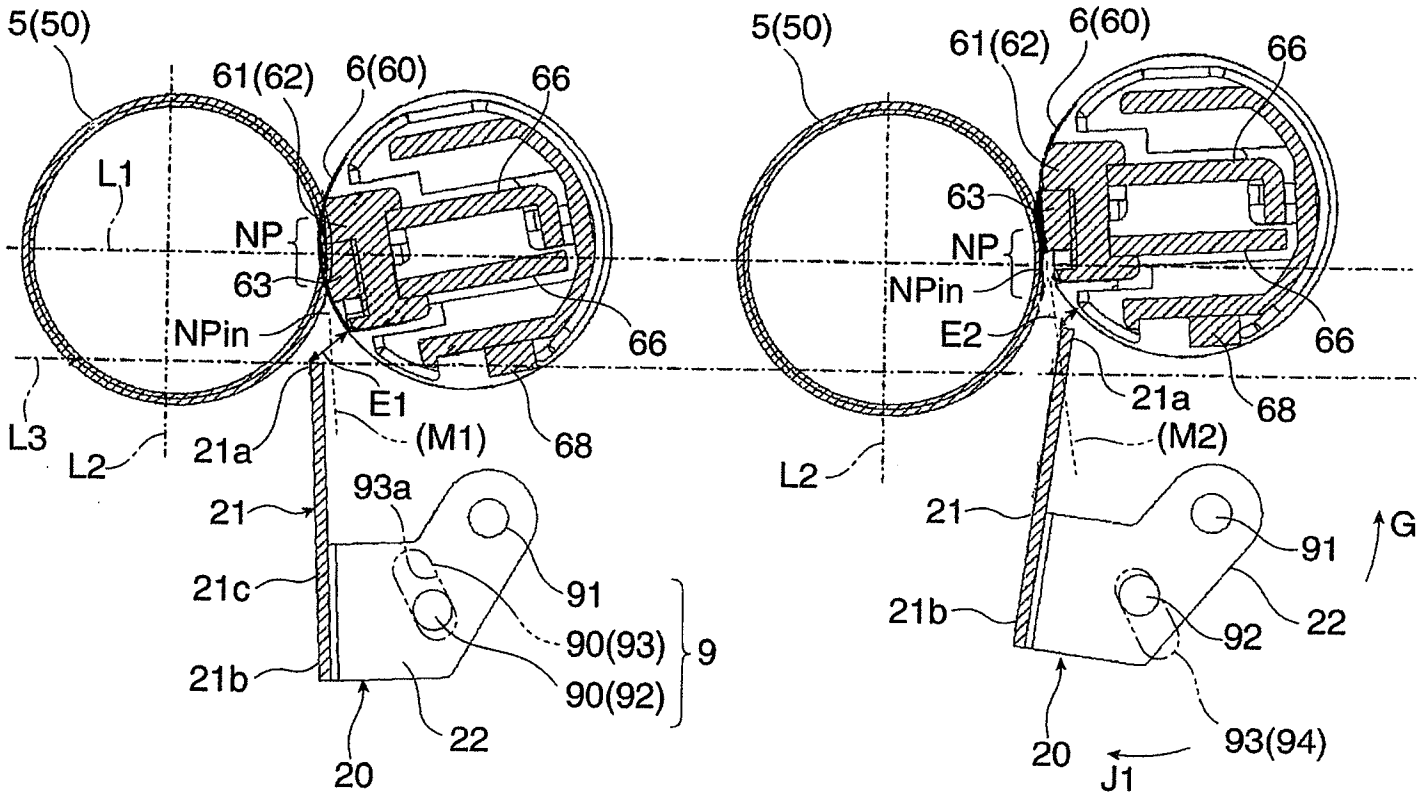
FIG. 7 is an explanatory view showing the contents of structures of setting positions respectively displaced by a displacing mechanism and adjusting positions respectively adjusted by an adjusting mechanism.

The pressing and support member 64 mainly includes, as shown in FIGS. 2 and 4, a side surface guide plate 65 that guides and supports both end parts and a part of an inner peripheral surface of the endless belt 60 so as to freely rotate and a support plate 66 that comes into contact with a back surface of the pressing member 61 (the head member 62 thereof) to support the pressing member. The two support plates 66 are used. Both end parts of each support plate are fitted to attaching holes not shown in the drawing which are formed in the side surface guide plate 65 and attaching holes formed in below-described swinging and holding plate 80 to hold the support plate. In FIGS. 2, 4 and 7, reference numeral 67 designates an inner peripheral surface guide plate for guiding (holding) the endless belt 60 from an inner peripheral surface of the belt 60 so as to hold and run the endless belt 60 in a cylindrical form. Reference numeral 68 designates an oil applying member that comes into contact with the inner peripheral surface of the endless belt 60 to apply lubricating oil thereto.

The displacing mechanism 7 includes a pressurizing mechanism 45 and a changing and switching mechanism 46.

The pressurizing mechanism 45 mainly includes a pair of pressurizing and swing frames 71A and 71B attached to a part of the fixing frames 53 so as to freely swing and two compression coils 73 and 74 provided to be divided to the pair of pressurizing and swing frames 71A and 71B to exhibit a resilient force for swinging the swing frames 71 so as to come close to the heating roll 50.

The pair of pressurizing and swing frames 71A and 71B are formed in configurations (bent parts 71*c*) bent once so as to go around the heating roll 50 in the direction separating from the heating roll 50 from the part 53*a* of the introducing side of the recording medium 10 in the fixing frame 53 to the part 53*b* as the feeding side of the recording medium.

The pressurizing and swing frames 71A and 71B attach a side end part of the recording medium as the introducing side with the pressure contract part NP held through the first shaft 56 between the fixing frames 53 and are swung in directions shown by arrow marks C and D so as to come close to or separate from the heating roll 50. Further, the pressurizing and swing frames 71A and 71B are provided with spring pressing surface parts 72 with which one ends of the two compression springs 73 and 74 come into contact to apply a resilient force thereof to an end part of the recording medium as the feeding side. The spring pressing surface parts 72 are bent inside and formed so as to be opposed to the spring support surface parts 57 of the fixing frames 53.

The compression coil springs 73 and 74 include a first compression spring 73 whose spring constant is large and a second compression spring 74 whose spring constant is smaller than that of the first compression spring 73. In the first exemplary embodiment, as the compression coils 73 and 74, compression coils whose free lengths are equal to each other are used. Conditions of the free length or the spring constant of the compression springs 73 an 74 may be suitably set depending on fixing conditions.

Further, the compression coil springs 73 and 74 are installed under a state that the compression coil springs 73 and 74 may press the spring pressing surface parts 72 of the pressurizing and swing frames 71 to swing in the direction C so as to come close to the heating roll 50. Further, the compression coil springs 73 and 74 are distributed and arranged at positions where clearances M from the first shaft 56 in the fixing frames 53 are different. In the first exemplary embodiment, the first compression coil spring 73 is arranged at the position where the distance M1 from the first shaft 56 is large, and the second compression coil spring 74 is arranged at the position where the distance M2 (<M1) from the first shaft 56 is small.

Further, as shown in FIG. 4, the compression coil springs 73 and 74 are attached by struts 75 inserted into coil winding spaces from one end parts thereof and having lengths (a dimension longer than the free length of the coil spring) protruding from the other end parts thereof. The strut 75 has a flange part 75*a* formed on an upper part of a main body of the strut which has a diameter larger than an outside diameter of the coil spring. On the other hand, on a lower part of the main body of the strut, a screw part 75*b* is formed whose diameter is smaller than a diameter of the main body of the strut. In the first exemplary embodiment, the first compression coil spring 73 uses the strut 75 (the main body part thereof) whose length is longer than the length of the strut 75 of the second compression coil spring 74. In FIG. 4, reference numeral 72*a* designates a strut insert hole (a hole having a diameter smaller than the outside diameter of the coil spring) formed on the spring pressing surface part 72 of the pressurizing and swing frame 71. Reference numeral 76 designates a nut for fixing the screw part 75*b* of the strut fitted respectively to a strut attaching hole formed on the spring support surface part 57 of the fixing frame 53.

The pressurizing mechanism 45 sandwiches and holds the compression coil springs 73 and 74 between the protruding parts 75*a* of the struts fixed to the spring support surface part 57 of the fixing frame 53 and the spring pressing surface part 72 of the pressurizing and swing frame 71 to compress the compression coil springs with a prescribed compression quantity. The compression quantity (P) of the compression spring at this time is substantially equal to a value obtained by subtracting a distance E between the spring pressing surface part 72 and the flange part 75*a* f the strut from the free length (L) of the compression spring (P=L−E). Since the strut 75 is fixed to the spring support surface part 57, the position of the flange part 75*a* of the strut is held at a fixed position.

In the pressurizing mechanism 45, the compression coil springs 73 and 74 press the spring pressing surface parts 72 of the pressurizing and swing frames 71A and 71B to come close to the spring support surface parts 57 of the fixing frames 53 by resilient forces F1 and F2 of the compression coil springs 73 and 74 respectively exhibited in accordance with the compression quantities and the spring constants at that time (see FIG. 4). Thus, the entire parts of the pressurizing and swing frames 71A and 71B are swung (swung in the direction shown by the arrow mark C) so as to come close to the heating roll 50. Then, a pressure (a pressing force) generated when the pressurizing and swing frames 71A and 71B are swung in the direction shown by the arrow mark C as described above is designed to be finally transmitted and applied to the pressing member 61 through a part corresponding to a structural part of the below-described changing and switching mechanism 46.

The changing and switching mechanism 46 is the structural part having a function that displaces at least a part of the pressing member 61 (the protruding part 62*a* of the head part 62 and the pad part 63) which comes into contact with the heating roll 50 under a prescribed pressure through the endless belt 60 between a first setting position set as a first position and a second position set at a downstream side of a passing direction B of the recording medium 10 in the pressure contact part NP from the first setting position. In the first exemplary embodiment, the first setting position set as the first position designates, for instance, a "setting position during an ordinary time set during an ordinary time", and the second position designates, for instance, a "setting position during a change". Further, the changing and switching mechanism 46 is also the structural part having a function that reduces a prescribed pressure applied to the pressing member 61 from the pressurizing mechanism 45 when the contact part of the pressing member 61 is displaced from the setting position during the ordinary time to the setting position during the change.

The changing and switching mechanism 46 in the first exemplary embodiment also serves as a part of the pressurizing mechanism 45 (a structural part for transmitting the pressure to the pressing member 61) as described above. In the changing and switching mechanism 46, the pressing member 61 is initially held in a swing and holding plate 80 attached to a part of the pressurizing and swing frame 71 in the pressurizing mechanism 45 so as to freely swing.

As shown in FIGS. 3 and 4, the swing and holding plates 80 are substantially rectangular plate members arranged in an adjacent state to both ends in the longitudinal direction of the pressing member 61. The swing and holding plate 80 fits a support shaft 81 provided in an end part 80*a* in an upstream side of the passing direction B of the recording medium 10 to a bearing hole 78 (FIG. 5) formed in a part nearer to an end part 71*b* in which the first shaft 56 is provided than to a central part of the pressurizing and swing frame 71 so as to freely rotate, so that the swing and holding plate 80 is attached to the pressurizing and swing frame 71 so as to freely swing thereto. Further, the swing and holding plate 80 fits an end part of the support plate 66 of the pressing member 61 to an attaching hole formed at a central part thereof to hold the pressing member 61. Accordingly, the swing and holding plate 80 swings in directions shown by arrow marks G and H on the support shaft 81 as a supporting point. Thus, the swing and holding plate 80 may displace at least the contact part (the head member 62 and the pad member 63) of the pressing member 61 held thereby with the heating roll 50 (through the endless belt 60) respectively in the directions of the downstream side and the upstream side of the passing direction B of an object to be fixed in the pressure contact part NP.

Figure 9:
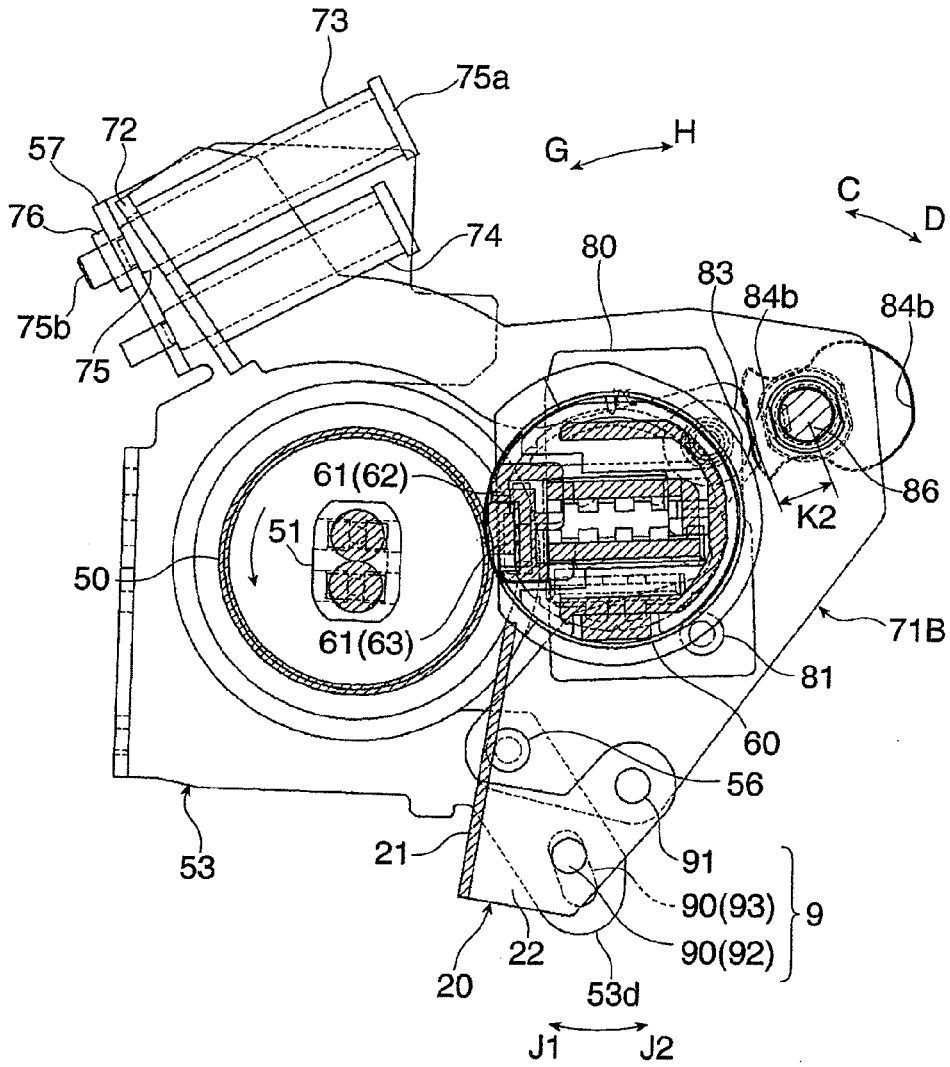
FIG. 9 is a partly sectional view showing a state of the fixing device shown in FIG. 4 during an envelope mode.
Figure 11:
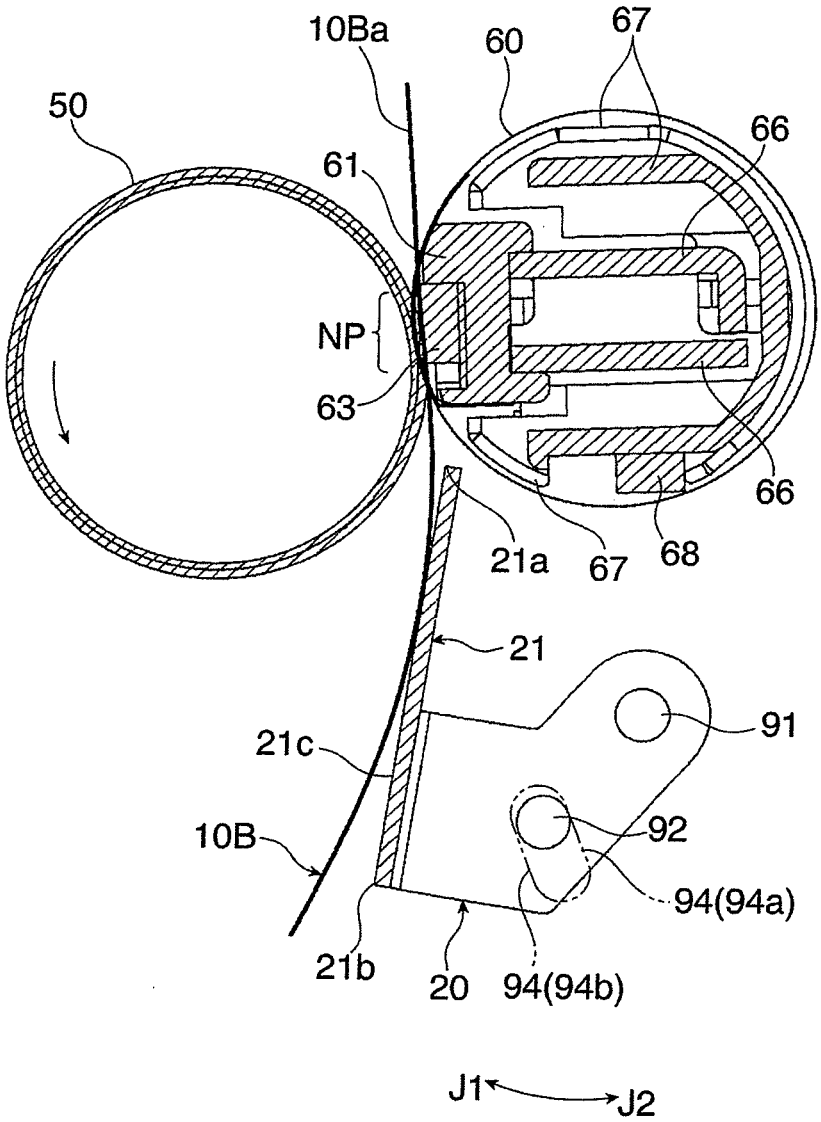
FIG. 11 is a sectional view showing a state of a main part of the fixing device shown in FIG. 9 during an envelope mode.

In the changing and switching mechanism 46, as the setting position during the ordinary time, is set a position where both the head member 62 and the pad member 63 of the pressing member 61 which is held by the swing and holding plate 80 come into contact with the heating roll 50 through the endless belt 60 (FIG. 4, FIG. 7 and FIG. 8). Further, as the setting position during the change, for instance, one next position is set. Namely, a position (a first setting position during a change) is set where the swing and holding plate 80 is swung in the direction shown by the arrow mark H to displace the contact part of the pressing member 61 to the downstream side in the passing direction B of the object to be fixed so that only the pad member 63 of the pressing member 61 comes into contact with the heating roll 50 through the endless belt 60 (FIG. 7, FIG. 9 and FIG. 11).

Further, in the changing and switching mechanism 46, since the swing and holding plate 80 is swung in the directions shown by the arrow marks G and H on the support shaft 81 as the supporting point, in an end part 80*b* of the swing and holding plate 80 as the downstream side of the passing direction B of the recording medium, a cam receiving member 83 is provided with which a cam comes into contact to receive an operation of the cam. Further, in the changing and switching mechanism 46, a change cam 84 which comes into contact with the cam receiving member 83 is provided substantially at a central part of the pressurizing and swing frame 71 of the pressurizing mechanism 45. The change cam 84 has not only a function as the changing and switching mechanism 46, but also a function for changing the state of the pressure applied from the pressurizing mechanism 45 and transmitting the pressure to the swing and holding plate 80.

The cam receiving member 83 is formed in such a way that in the end part 80*b* of the swing and holding plate 80, a shaft 85 is provided to protrude outward at a position shifting to the downstream side of the passing direction B of the object to be fixed from the pressure contact part NP and a disk shaped rotating member is attached to the shaft 85 so as to freely rotate. The cam receiving member (the rotating member) 83 is arranged so as to pass through a bent part 71*c* of the pressurizing and swing frame 71 and come into contact with the change cam 84 at an outer position of the pressurizing and swing frame 71.

Figure 5:
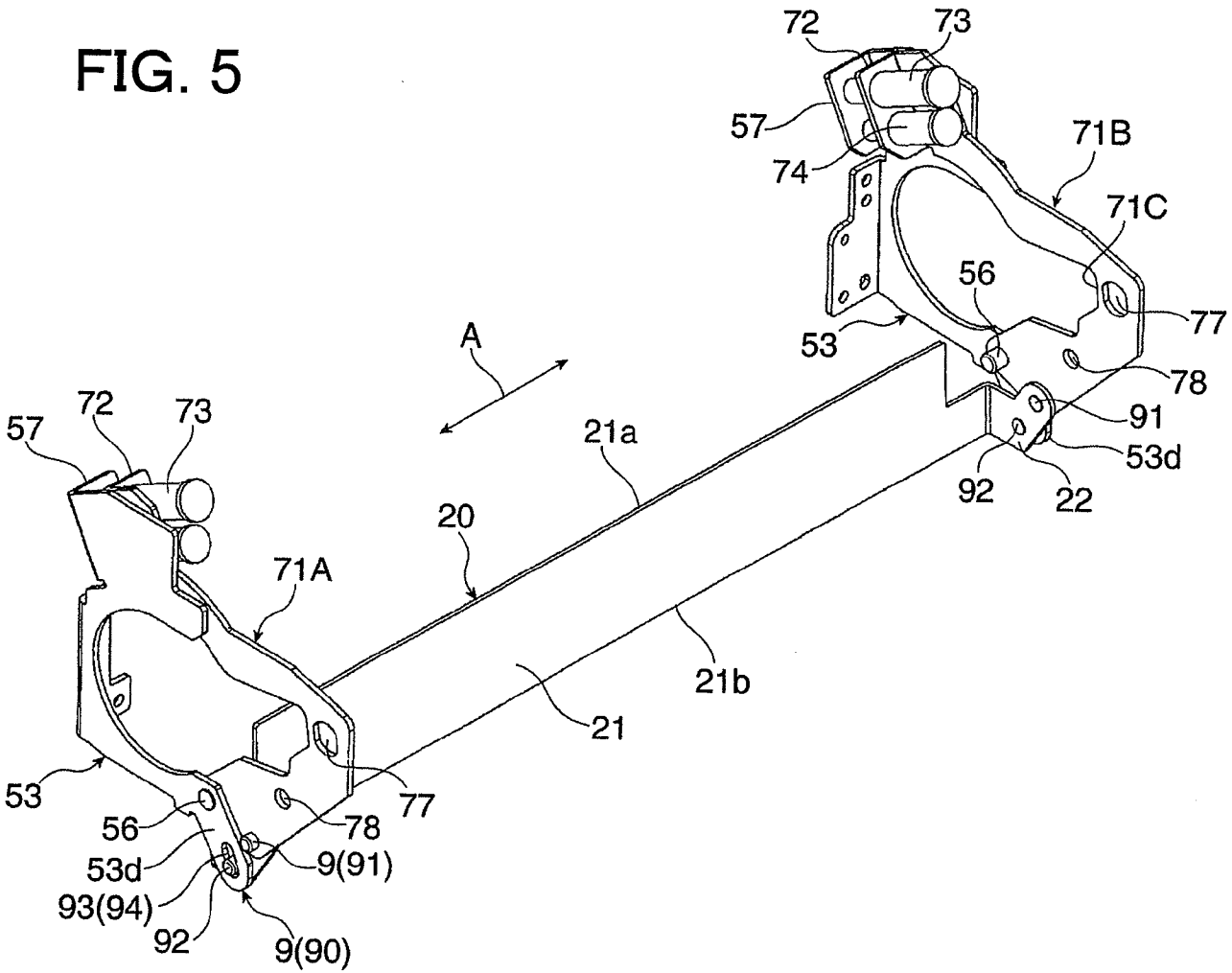
FIG. 5 is a perspective view showing a part of the fixing device shown in FIG. 3 (a state that a guide plate is located at a first adjusting position)

The change cam 84 is attached to a part of the pressurizing and swing frame 71 so as to freely rotate and arranged so as to come into contact with the cam receiving member 83 of the swing and holding plate 80. The change cams 84 in the first exemplary embodiment are respectively attached, under fixed states, to a connecting shaft 86 for attaching the cam so as to freely rotate at parts slightly shifting in the downstream side of the passing direction B of the object to be fixed from the pressure contact part NP in the bent parts 71*c* of the pressuring and swing frames 71A and 71B respectively at the outer positions of the pressurizing and swing frames 71A and 71B. The connecting shaft 86 is, as shown in FIGS. 3 and 5, attached to shaft attaching holes 77 provided in the above-described parts of the pressurizing and swing frames 71 so as to freely rotate through bearings.

The change cam 84 includes at least two cam surfaces, that is, a first cam surface 84*a* and a second cam surface 84*b* for adjusting a distance (a clearance from the cam connecting shaft 86) relative to a contact point when the change cam 84 comes into contact with the cam receiving member 83 in the swing and holding plate 80 (FIG. 4). The change cam 84 is positioned under a state in which one of the two cam surfaces comes into contact with the cam receiving member 83.

The first cam surface 84*a* is a surface formed so as to be located at the remotest position (K1: a radius of a cam) from the connecting shaft 86 of the two cam surfaces and used as the cam surface when the contact part of the pressing member 61 is arranged at the setting position during the ordinary time. The first cam surface 84*a* is formed as an outer peripheral surface of a large diameter part having a part in which the radius of a cam has a maximum value. The second cam surface 84*b* is a surface formed so as to be located at a position nearer to the cam connecting shaft 86 than the first cam surface 84*a* (K2<K1) and used as the cam surface when the pressing member 61 is arranged so that the contact part of the pressing member 61 is set to the setting position during the change.

The changing and switching mechanism 46 also has a function for switching the contact part of the pressing member 61 with the heating roll 50 (through the endless belt 60) either to a state during an ordinary time when the contact part is located at the setting position during the ordinary time, or to a state during a change when the contact part is located at the setting position during the change.

In the first exemplary embodiment, the changing and switching mechanism includes the connecting shaft 86 for fixing the two change cams 84 and an operating lever, which is not shown in the drawing, fixed and attached to one end part 86*a* of the connecting shaft 86. The operating lever may be swung so as to be inclined at a prescribed angle on the one end part 86*a* of the connecting shaft 86. Thus, in accordance with the swing operation, at least one of the two cam surfaces 84*a* and 84*b* of the change cam 84 fixed to the connecting shaft 86 is functionally switched to respectively come into contact with the cam receiving member 83.

In the fixing device 4, the state during the ordinary time is applied to a case that the image is formed (including a fixing process) by using as the recording medium 10, the sheet as a sheet shaped material (except an envelope shaped material. For instance, an ordinary sheet, a thick sheet or the like) (corresponding to a case that a below-described "ordinary mode" is selected.). Further, the state during the change is applied to a case that the image is formed by using the envelope shaped material as the recording medium 10 (corresponding to a case that a below-described "envelope mode" is selected. See FIG. 13).

Further, in the fixing device 4, as shown in FIGS. 2 to 11, the adjusting mechanism 9 is provided for adjusting the guide plate 20 arranged in an introducing side of the recording medium 10 as the object to be fixed to prescribed states respectively suitable for the setting positions in accordance with a displacement, when the contact part (the head member 62 and the pad member 63) of the pressing member 61 in the pressing rotating member 6 is displaced by the displacing mechanism 7 (the changing and switching mechanism 46 thereof) so as to be located either at the setting position during the ordinary time or the setting position during the change.

As shown in FIG. 7, the adjusting mechanism 9 adjusts, in accordance with the displacement of the pressing member 61 by the displacing mechanism 7, the guide plate 20 so as to be either in a first adjusting state in which an end part 21*a* of a guide part 21 near to the pressure contact part NP is located at a position closer to the surface (a fixing surface) of the heating roll 50 than to the surface of the endless belt 60 and a prescribed space E1 separated from the introducing port NPin of the pressure contact part NP or in a second adjusting state in which the end part 21*a* is located at position closer to the surface of the endless belt 60 than to the surface f the heating roll 50 and nearer to the introducing port NPin of the pressure contact part NP (a space E2 from the introducing port NPin is smaller than the space E1) than in the case of the first adjusting state.

Here, the guide part 21 of the guide plate 20 is a part of the guide plate 20 with which the recording medium 10 comes into contact to guide the recording medium. The end part 21*a* of the guide part 21 near to the pressure contact part NP is an end part including a part with which at least an end part of the recording medium 10 as a taking—in side comes into contact to exhibit a function for actually guiding the recording medium 10. Further, the position of the end part 21*a* of the guide part close to the surface of the heating roll 50 or the endless belt 60 is relatively determined depending on the dimensions of clearances (the shortest) from the surfaces of the heating roll 50 and the endless belt 60 respectively. Further, the introducing point NPin is a point where the heating roll 50 comes into first contact with the endless belt 60 in the pressure contact part NP. Further, a space E between the end part 21*a* of the guide part and the introducing port NPin of the pressure contact part NP corresponds to a rectilinear distance between the end part 21*a* and the introducing port NPin.

Further, in FIG. 7, a dashed line L1 is a horizontal line passing a center of the heating roll 50. A dashed line L2 is a vertical line to the horizontal line of the dashed line L1 in the center of the heating roll 50. L3 is a line showing a height in the vertical direction of the end part 21*a* of the guide part in the first adjusting state. Further, dotted lines M1 and M2 designate bisectors (corresponding to boundaries of an arranging area of the heating roll 50 and an arranging area of the endless belt 60) in wedge shaped spaces formed before the introducing ports NPin of the pressure contact parts NP respectively at the time of the ordinary mode and the envelope mode.

Then, the adjusting mechanism 9 in the first exemplary embodiment is set to be adjusted to the first adjusting state at the time of changing to the setting position during the ordinary time by the displacing mechanism 7 (at the time of selecting the ordinary mode) and to the second adjusting state at the time of changing to the setting position during the change (at the time of selecting the envelope mode).

Such an adjusting mechanism 9 includes a stop mechanism 90 in which the guide plate 20 is attached to the pressurizing and swing frame 71 in the displacing mechanism 7 through a second shaft 91 so as to be swung and the guide plate swung in accordance with the swing operation of the pressurizing and swing frame 71 is stopped at positions respectively for holding the guide plate 20 in the first adjusting state and the second adjusting state.

Figure 6:
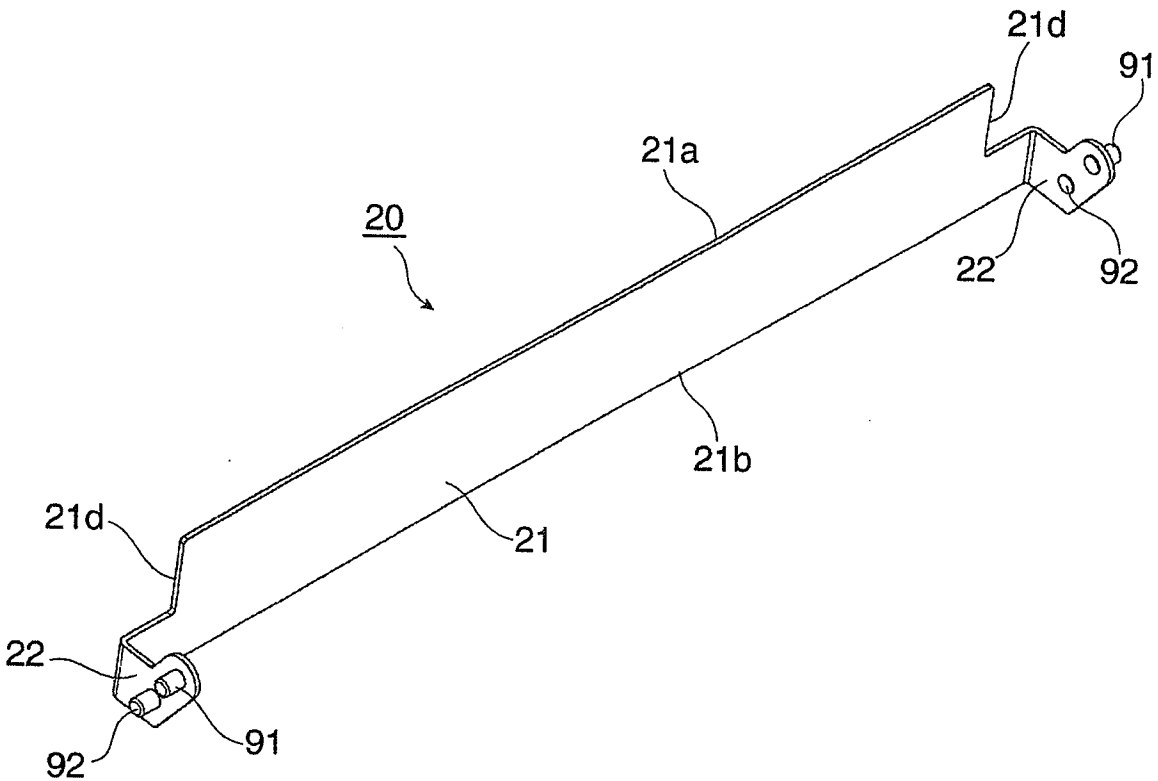
FIG. 6 is a perspective view of the guide plate in the fixing device shown in FIG. 4.

As the guide plate 20, as shown in FIGS. 5 and 6, a guide plate is used which has a form including a rectangular and flat plate shaped guide part 21 having a length longer than a length of an effective fixing area in the axial direction of the heating roll 50 and a pair of attaching arm parts (extended attaching parts) 22 extending from both end parts of the guide part 21 and formed so as to be opposed to a part of the pressurizing and swing frames 71.

In the guide part 21, a surface 21*c* (a guide surface) of a side with which the recording medium 10 actually comes into contact is formed with a flat surface. On the guide surface 21*c*, a line shaped protruding part (a rib) extending in the transporting direction of the recording medium 10 may be formed. Further, the attaching arm parts 22 are formed in such a way that parts of both end parts 21*d* of the guide part 21 separated from the pressure contact part NP extended outward, then bent to an opposite side (a back surface side) to the guide surface 21*c* of the guide part 21 and extended to attaching positions (positions where the second shafts 91 are attached) of the pressurizing and swing frames 71. The attaching positions of the pressurizing and swing frames 71 are positions a prescribed space separated outward (a side where the endless belt 60 is present) from the first shaft 56 and where the end part 21*a* of the guide part may be located in the first and second adjusting states respectively.

In end parts of the attaching arm parts 22, the second shafts 91 are provided as a part of the adjusting mechanism 9 for attaching the guide plate 20 to the attaching positions of the pressurizing and swing frames 71 so as to freely swing. The end parts of the attaching arm part 22 are bent to a side that comes close to the endless belt 60. Further, on other part of the attaching arm parts 22, the stop mechanisms 90 as a part of the adjusting mechanism 9 are provided that stop the guide plate 20 at the positions respectively for holding the guide plate 20 in the first adjusting state and the second adjusting state.

The stop mechanism 90 includes a protruding pin 92 provided at a position closer to the guide part 21 than the second shaft 91 in the attaching arm part 22 and close to an end part 21*b* of the guide part separated from the pressure contact part NP so as to protrude outward (a side where the pressurizing and swing frame 71 is present) and a fixed structural part 93 having a contact part 93*a* with which the protruding pin 92 comes into contact to prevent the guide plate 20 from swinging. In the fixed structural part 93, an extending part 53*d* is formed that extends in a direction separating from the pressure contact part NP in the end part 53*a* of the fixing frame 53 as the introducing side of the recording medium. In the extending part 53*d*, a stop slot 94 to which the protruding pin 92 is fitted is formed.

The stop slot 94 is a slot having such a form as to permit the guide plate 20 attached to the pressurizing and swing frame 71 to swing in directions shown by arrow marks J1 and J2 on the second shaft 91 as a supporting point when the pressurizing and swing frame 71 is swung in the directions shown by the arrow marks G and H and to stop the guide plate 20 at the positions for holding the guide plate 20 respectively in the first adjusting state and the second adjusting state through the protruding pin 92 when the swing operation of the pressurizing and swing frame 71 to the directions shown by the arrow marks G and H is stopped. In the stop slot 94, a linear (shaft side) long side part 94*a* of a pair of parallel long side parts 94*a* and 94*b* near to the second shaft 91 serves as a contact part for preventing the guide plate 20 from swinging in the direction shown by the arrow mark J2 on the second shaft 91 as the supporting point and the linear (guide part side) long side part 94*b* separated from the second shaft 91 serves as a contact part for preventing the guide plate 20 from swinging in the direction shown by the arrow mark J1 on the second shaft 91 as the supporting point (see FIG. 8).

An end part 21*b* of the guide part 21 separated from the pressure contact part NP is displaced interlocking with the displacement of the end part 21*a* near to the pressure contact part NP to the first adjusting state and the second adjusting state. As long as the end part 21*b* in the guide part of the guide plate 20 is located at a position where at least the recording medium 10 transported from a transfer part (the transfer position) as a pre-process of a fixing process is not prevented from reaching the guide part 21 of the guide plate 20 and a guide operation by the end part 21*a* of the guide part near to the pressure contact part NP is not prevented from being effectively exhibited, the position of the end part 21*b* is not especially limited. In this connection, when the end part 21*a* opposite to the end part 21*b* is displaced respectively to the first adjusting state and the second adjusting state, the end part 21*b* of the guide part of the guide plate 20 in the first exemplary embodiment is located in an area side where the heating roll 50 is arranged (with the bisectors M1 and M2 in the introducing port NPin of the pressure contact part NP set as the boundaries) in both the adjusting states (see FIG. 7).

Now, an operation of the fixing device 4 will be described below.

Initially, an operation will be described (the ordinary mode) when the image is formed by using, as the recording medium 10, the sheet (the ordinary sheet, etc.) 10A except the envelope shaped material.

In the fixing device 4, when the ordinary mode is selected, as shown in FIGS. 4 and 7, when the operating lever not shown in the drawing in the changing and switching mechanism 46 of the displacing mechanism 7 is operated, the change cam 84 is held in a state in which the first cam surface 84*a* thereof comes into contact with the cam receiving member 83 of the swing and holding plate 80.

Thus, in the pressurizing mechanism 45 of the displacing mechanism 7, since the connecting shaft 86 of the change cam 84 is located in a state that the connecting shaft is moved to a position most separated from the cam receiving member 83, the pressurizing and swing frame 71 to which the change cam 84 is attached is swung in a direction separating from the heating roll 50 shown by an arrow mark D on the first shaft 56 as a supporting point. At this time, the spring pressing surface part 72 of the pressurizing and swing frame 71 is moved in a direction separating from the spring support surface part 57 of the fixing frame 53 to maintain a state in which a prescribed distance is set. Further, at this time, a distance between the spring pressing surface part 72 of the pressurizing and swing frame 71 and the flange part 75*a* of each strut 75 is a distance for the ordinary mode. The distance for the ordinary mode is set to a value smaller than both the free length L1 of the first compression spring 73 and the free length L2 of the second compression coil spring 74. Accordingly, both the two compression coil springs 73 and 74 are held in a compressed state.

In the ordinary mode, since the first compression coil spring 73 and the second compression coil spring 74 exhibit the resilience forces F1*a* and F2*a* (=the compression quantity×the spring constant) corresponding to their compression quantities and spring constants, the resilient forces F1*a* and F2*a* allow the spring pressing surface part 72 to be continuously pressed so as to come close to the spring support surface part 57 of the fixing frame 53. Accordingly, a state is maintained in which the pressurizing and swing frame 71 is swung to come close to the heating roll 50 (the arrow mark C). At this time, since a "principle of lever" including the first shaft 56 as a supporting point, the spring pressing surface part 72 as a force point and the change cam 84 as an operating point is exerted on the pressurizing and swing frame 71, a strong force obtained by increasing the resilient forces F1*a* and F2*a* based on the principle of lever is transmitted from the pressurizing and swing frame 71 to the change cam 84 as the operating point.

As a result, since the pressurizing and swing frame 71 presses the swing and holding plate 80 so as to come close to the heating roll 50 through the change cam 84 and the cam receiving member 83, the pressing member 61 of the pressing rotating member 6 supported by the swing and holding plate 80 through the support plate 66 of the pressing and support member 64 is pressed to the heating roll 50 under high pressure X required during the fixing process in the ordinary mode. At this time, in the heating roll 50 attached and fixed to the fixing frame 53, a reaction force is generated as a reaction to the above-described pressure X. Thus, the reaction force and the load (the pressing force) by the pressurizing mechanism 45 are balanced so that the pressurizing and swing frame 71 is located in a stationary state.

Further, in the ordinary mode, the pressurizing and swing frame 71 holds a state that the pressurizing and swing frame 71 allows the swing and holding plate 80 to swing in the direction shown by the arrow mark C so as to come close to the heating roll 50 through the change cam 84 as a part of the displacing mechanism 7. Thus, since a state is maintained that the swing and holding plate 80 as a part of the displacing mechanism 7 is swung in the direction as shown by the arrow mark G on the shaft 81 as the supporting point, the pressing member 61 is moved to the upstream side of the passing direction B of the object to be fixed in the pressure contact part NP. Finally, a state is maintained that both the head member 62 (the protruding part 62*a* thereof) and the pad member 63 as the contact part of the pressing member 61 press the endless belt 60 toward the heating roll 50 (see FIG. 4 and FIG. 7). At this time, a position where both the head member 62 and the pad member 63 of the pressing member 61 come into contact with the heating roll 50 to stop is the above-described setting position during the ordinary time.

Further, when the contact part (the head member 62 and the pad member 63) of the pressing member 61 is displaced so as to be located at the setting position during the ordinary time by the displacing mechanism 7, the guide plate 20 is adjusted so that the guide part 21 thereof is set to the first adjusting state (contents shown in the left half part of FIG. 7) by the adjusting mechanism 9.

Namely, in the guide plate 20, the second shaft 91 in the attaching arm part 22 is positioned to a position where the pressurizing and swing frame 71 of the pressurizing mechanism 45 in the displacing mechanism 7 is located in the stationary state. Further, the guide plate 20 is stopped under a state that the protruding pin 92 of the stop mechanism 90 in the attaching arm part 22 comes into contact with a part of the stop slot 94 of the stop mechanism 90 formed in the extending part 53*d* of the fixing frame 53. Specifically, at this time, as shown in FIG. 8, the protruding pin 92 is located in such a state as to be opposed to and come into contact with a lower side position of the long side part 94*a* of the shaft side and a lower side position of the long side part 94*b* of the guide part side of the stop slot 94. Thus, the guide plate 20 is prevented from swinging in the directions shown by the arrow marks J1 and J2 on the second shaft 91.

As a result, as shown in the left half part of FIG. 7 or FIG. 8, the guide plate 20 is set to the first adjusting state in which the end part 21*a* of the guide part 21 near to the pressure contact part NP is located at the position closer to the surface of the heating roll 50 than to the surface of the endless belt 60 and the prescribed space E1 separated from the introducing port NPin of the pressure contact part NP. At this time, the end part 21*b* of the guide plate 20 separated from the pressure contact part NP is located in the arranging area of the heating roll 50 (FIG. 7). Further, the guide surface 21*c* of the guide part 21 is in a state of generally moving forward to the surface of the heating roll 50 with the end part 21*a* separated from the pressure contact part NP.

As described above, in the ordinary mode, the high pressure X for the fixing process is applied to the pressure contact part NP of the fixing device 4 through the pressing member 61, and the pressure contact part NP is formed by the pressing operation of both the head member 62 (the protruding part 62*a* thereof) and the pad member 63 of the pressing member 61. Further, in the pressure (distribution) applied to the pressure contact part NP of the heating roll 50 during the selection of the ordinary mode, a pressure applied by the head member 62 arranged in the downstream side of the passing direction B of the object to be fixed is larger than a pressure applied by the pad member 63 located in the upstream side in the passing direction B of the object to be fixed in the pressure contact part NP. Further, in the guide plate 20, the guide part 21 is set to the first arranging state by the adjusting mechanism 9.

Then, during the selection of the ordinary mode, when the sheet shaped recording medium 10A holding the unfixed toner image is introduced to an inner part through the taking-in port 41 of the fixing device 4, as shown in FIG. 8, the recording medium 10A is guided by the guide plate 20 located in the first adjusting state to be guided to the introducing port NPin of the pressure contact part NP. Namely, in the recording medium 10A, an end part 10Aa in the downstream side of a transporting direction is moved in contact with the guide surface 21*c* of the guide part 21 in the guide plate 20, and finally guided by the end part 21*a* near to the pressure contact part NP to enter the introducing port NPin. Specifically, the end part 10Aa of the recording medium 10A is guided by the end part 21*a* of the guide part located at a position close to the heating roll 50 to move forward in the prescribed space E1 to the introducing port NPin of the pressure contact part NP under a state that the end part 10Aa comes close to the surface of the heating roll 50.

Thus, even when the recording medium 10A is a partly water including sheet which is wavy in the direction of width of the recording medium due to a fact that the recording medium 10A partly includes much moisture, after the end part 10Aa of the recording medium 10A as the partly water including sheet enters the pressure contact part NP, a subsequent part receives an operation in which the subsequent part is forcibly allowed to come into contact with the end part 21*a* of the guide part stepped from the pressure contact part NP and is extended. Accordingly, wrinkles are more restrained from being generated in a rear end side of the recording medium 10A than a case that does not receive the above-described operation.

Subsequently, when the recording medium 10A is introduced into the pressure contact part NP, initially, the pad member 63 of the elastic member arranged in the upstream side of the passing direction B of the object to be fixed in the pressure contact part NP presses the recording medium 10A to the rotating heating roll 50 (through the endless belt 60). Then, the head member 62 (the protruding part 62*a* thereof) of the inelastic member arranged in the downstream side of the passing direction B of the object to be fixed in the pressure contact part NP press the recording medium 10A to the heating roll 50 (through the endless belt 60). As described above, in the ordinary mode, the fixing process is carried out in which the sheet shaped recording medium 10A is allowed to pass the pressure contact part NP having the distribution of different pressures in the passing direction B thereof.

Now, an operation will be described when the image is formed by using an envelope shaped material 10B such as an envelope as the recording medium 10 (the envelope mode).

In the fixing device 4, when the envelope mode is selected, as shown in FIGS. 7, 9 and 11, when the operating lever not shown in the drawing in the changing and switching mechanism 46 of the displacing mechanism 7 is operated, the change cam 84 is held in a state in which the second cam surface 84*b* thereof comes into contact with the cam receiving member 83 of the swing and holding plate 80.

Thus, in the pressurizing mechanism 45 of the displacing mechanism 7, as shown in FIG. 9, since the connecting shaft 86 of the change cam 84 is located in a state that the connecting shaft 86 is moved to a position closer to the cam receiving member 83 than that during the selection of the ordinary mode, the pressurizing and swing frame 71 is swung in a direction coming near to the heating roll 50 shown by an arrow mark C. As a result, the spring pressing surface part 72 of the pressurizing and swing frame 71 is moved in a direction coming near to the spring support surface part 57 of the fixing frame 53 and held at a position with a prescribed distance set.

Further, at this time, a distance between the spring pressing surface part 72 and the flange part 75*a* of each strut 75 of the two compression coil springs 73 and 74 is a distance for the envelope mode. The distance for the envelope mode in the compression coil spring 73 side is set to a value larger than the free length L1 of the first compression spring 73. The distance in the second compression spring 74 side is set to a value smaller than the free length L2 of the second compression coil spring 74. Further, since the first compression spring 73 is arranged at a position more separated from the first shaft 56 than that of the second compression spring 74, the distance in the first compression spring 73 side is larger than the distance in the second compression spring 74 side. Accordingly, in the pressurizing mechanism 45, while the first compression spring 73 has the free length (L1) and is not compressed, the second compression spring 74 is slightly extended more than during a first pressing operation, however, held in a slightly compressed state.

In the envelope mode, since only the second compression coil spring 74 exhibits the resilience force F2*b* (=the compression quantity×the spring constant) corresponding to the compression quantity and the spring constant, the resilient force F2*b* allows the spring pressing surface part 72 to be continuously pressed so as to come close to the spring support surface part 57. Accordingly, a state is maintained in which the pressurizing and swing frame 71 is swung to come close to the heating roll 50 (the direction shown by the arrow mark C). At this time, the "principle of lever" is exerted on the pressurizing and swing frame 71 similarly to the case during the ordinary mode, however, only the resilient force F2*b* by the second compression coil spring 74 is increased by the principle of lever, so that a force weaker than that during the ordinary mode is transmitted to the change cam 84 as the operating point. Further, since the second compression coil spring 74 is extended more than during the ordinary mode to reduce the compression quantity, the resilient force F2*b* itself is weakened.

As a result, the pressurizing and swing frame 71 presses the swing and holding plate 80 so as to come close to the heating roll 50 in the direction shown by the arrow mark C, however, since the force transmitted to the change cam 84 is weaker than that during the ordinary mode, the pressing member 61 supported by the swing and holding plate 80 is pressed to the heating roll 50 under a pressure Y (<X) lower than the high pressure X required during the fixing process in the ordinary mode. The pressure (distribution) applied to the pressure contact part NP of the heating roll 50 during the envelope mode is a low pressure applied only by the pad member 63. This pressure is smaller than the level of the pressure X applied during the ordinary mode. Further, since the pad member 63 is made of the elastic member, in the pressure contact part NP, the pad member 63 side is liable to be elastically deformed.

Further, also in the envelope mode, the pressurizing and swing frame 71 holds a state that the pressurizing and swing frame 71 allows the swing and holding plate 80 to swing so as to come close to the heating roll 50 through the change cam 84 as in the case of selecting the ordinary mode.

However, in this case, since the force for pressing the swing and holding plate 80 by the pressurizing and swing frame 71 is weaker than that during the ordinary mode and a force for pressing the heating roll 50 by the pressing member 61 is also weak, the pressing member 61 receives a force generated by a frictional force of the heating roll 50 rotating in the direction shown by the arrow mark and the endless belt 60 driven and rotated thereby. Thus, the swing and holding plate 80 is maintained in a state that the swing and holding plate is swung in the direction shown by the arrow mark H on the shaft 81 as the supporting point.

As a result, since a state is maintained that the pressing member 61 is displaced to a position shifting in the downstream side of the passing direction B of the object to be fixed in the pressure contact part NP, the head member 62 (the protruding part 62*a* thereof) of the pressing member 61 is moved in the direction separating from the heating roll 50 so as not to press the heating roll 50. On the other hand, the pad member 63 moves to a position opposed to the heating roll 50 to press the endless belt 60 to the heating roll 50 (changed). A position where the pad member 63 of the pressing member 61 as the contact part at this time comes into contact with the heating roll 50 and stops is the setting position during the change.

Further, when the contact part (the head member 62 and the pad member 63) of the pressing member 61 is displaced so as to be located at the setting position during the change by the displacing mechanism 7, the guide plate 20 is adjusted so that the guide part 21 thereof is set to the second adjusting state (contents shown in the right half part of FIG. 7) by the adjusting mechanism 9.

Figure 10:
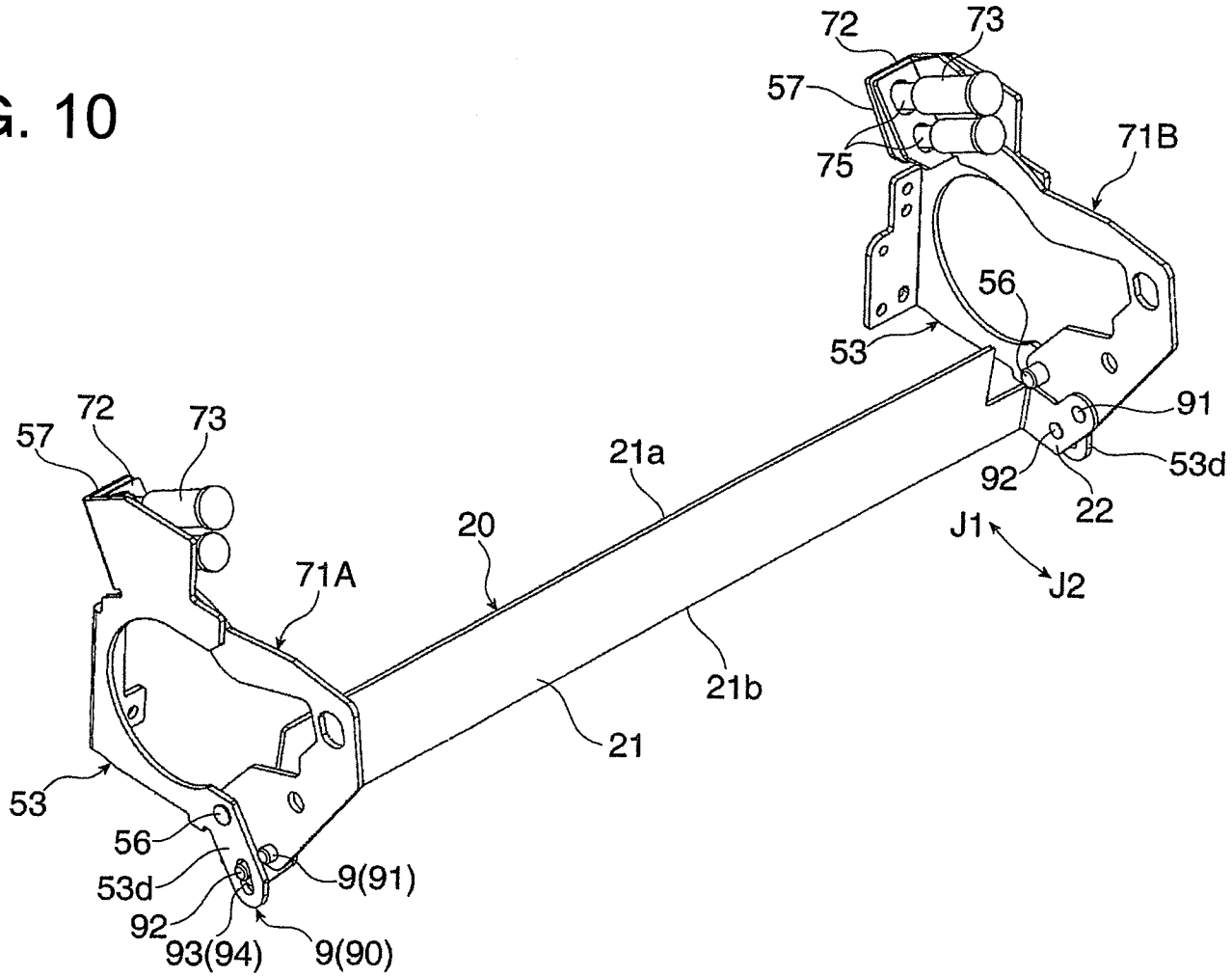
FIG. 10 is a perspective view showing a part of the fixing device shown in FIGS. 3 and 9 (a state that a guide plate is located at a second adjusting position)

Namely, in the guide plate 20, as shown in FIGS. 9 to 11, the second shaft 91 in the attaching arm part 22 is positioned to a position where the pressurizing and swing frame 71 of the pressurizing mechanism 45 in the displacing mechanism 7 is swung in the direction shown by the arrow mark C and then located in the stationary state. Further, the guide plate 20 is stopped under a state that the protruding pin 92 of the stop mechanism 90 in the attaching arm part 22 comes into contact with the other part of the stop slot 94 of the stop mechanism 90 formed in the extending part 53*d* of the fixing frame 53. Specifically, as shown in FIG. 11, the protruding pin 92 at this time is located in such a state as to be opposed to and come into contact with an upper side position of the long side part 94*a* of the shaft side and an upper side position of the long side part 94*b* of the guide part side of the stop slot 94. Thus, the guide plate 20 is prevented from swinging in the directions shown by the arrow marks J1 and J2 on the second shaft 91.

As a result, as shown in the right half part of FIG. 7 or FIG. 11, the guide plate 20 is set to the second adjusting state in which the end part 21*a* of the guide part 21 near to the pressure contact part NP is located at the position closer to the surface of the endless belt 60 than to the surface of the heating roll 50 and nearer to the introducing port NPin of the pressure contact part NP with a space E2 (<E1) from the introducing port NPin than in the case of the first adjusting state. At this time, the end part 21*b* of the guide plate 20 separated from the pressure contact part NP is located in the arranging area side of the heating roll 50 (FIG. 7) and further enter more inside the arranging area of the heating roll than in the case of the first adjusting state. Further, the guide surface 21*c* of the guide part 21 is in a state of generally moving forward to the surface of the endless belt 60 with the end part 21*a* coming close to the pressure contact part NP.

As described above, in the envelope mode, the low pressure Y for the envelope mode is applied to the pressure contact part NP of the fixing device 4 through the pressing member 61, and the pressure contact part NP is formed only by the pressing operation of the pad member 63 of pressing member 61 made of the elastic member.

Then, during the selection of the envelope mode, when the envelope shaped recording medium 10B holding the unfixed toner image is introduced to an inner part of the pressure contact part NP through the taking-in port 41 of the fixing device 4, as shown in FIG. 11, the recording medium 10B is guided by the guide plate 20 located in the second adjusting state to be guided to the introducing port NPin of the pressure contact part NP.

Namely, in the recording medium 10B, an end part 10Ba in the downstream side of a transporting direction is moved in contact with the guide surface 21*c* of the guide part 21 in the guide plate 20, and finally guided by the end part 21*a* near to the pressure contact part NP to enter the introducing port NPin. Specifically, the end part 10Ba of the recording medium 10B is guided by the end part 21*a* of the guide part located at a position more separated from the heating roll 50 than the position during the selection of the ordinary mode to move forward in the prescribed space E2 to the introducing port NPin of the pressure contact part NP under a state that the end part 10Ba comes close to the surface of the endless belt 60.

Thus, in a stage before the envelope shaped recording medium 10B reaches the introducing port NPin of the pressure contact part NP, the envelope shaped recording medium 10B is moved to the introducing port NPin of the pressure contact part NP under a state that the recording medium 10B is separated from the heating roll 50. Therefore, the unfixed toner image held in the envelope shaped recording medium 10B whose thickness is larger than the ordinary sheet is prevented from coming into contact with the surface of the heating roll 50 to be turbulent.

Further, since the end part 21*a* of the guide part is located at the position closer to the surface of the endless belt 60 than the position in the case of the first adjusting state, however, located at the position nearer to the introducing port NPin of the pressure contact part NP, the end part 10Ba of the recording medium 10B enters the introducing port NPin of the pressure contact part NP without colliding with the surface of the endless belt 60 before the end part 10Ba of the recording medium 10B enters the introducing port NPin of the pressure contact part NP. Accordingly, occurrences are prevented that the unfixed toner image is turbulent, wrinkles are generated in the recording medium 10B or an imperfect transporting operation (the clogging of the end part of the recording medium 10B before the pressure contact part NP) arises due to an impact caused by the collision of the end part 10Ba of the recording medium 10B with the surface of the endless belt 60.

Subsequently, when the envelope shaped recording medium 10B is introduced into the pressure contact part NP, only the pad member 63 with an elasticity to which the low pressure Y is applied presses the recording medium 10B to the heating roll 50 (through the endless belt 60). In such a way, in the envelope mode, since the fixing process to the envelope shaped recording medium 10B is carried out under the pressure lower than that during the ordinary mode, the pressure contact part NP is elastically deformed in accordance with the passing state of the recording medium 10B and, in addition thereto, the pressurizing and swing frame 71 is swung by a necessary quantity relative to the fixing frame 53 in accordance with the passing state, the fixing process is carried out under an environment in which a mutually (dynamically) balanced state is obtained as a whole. Further, in the envelope mode, the compression coil springs 73 and 74 of the pressurizing mechanism 45 are not more forcibly compressed than those during the ordinary mode. As a result, during the envelope mode, in the envelope shaped recording medium 10B (especially, an end area in the upstream side of the passing direction B of the recording medium), the wrinkles are not generated so that a good fixing process may be realized.

In this connection, during the selection of the ordinary mode, when the fixing device 4 applies the fixing process to the envelope shaped recording medium 10B, below-described results are obtained.

Namely, since the end part 21*a* of the guide part in the guide plate 20 near to the pressure contact part NP is located at the position closer to the surface of the heating roll 50 (see the left half part of FIG. 7 or FIG. 8), a space between the end part 21*a* of the guide part and the surface of the heating roll 50 is narrow for the envelope shaped recording medium 10B with two sheets piled whose thickness is larger than the thickness of the ordinary sheet. Thus, the unfixed toner image may occasionally come into contact with the surface of the heating roll 50 to be turbulent.

Further, during the selection of the envelope mode, the end part 21*a* of the guide part in the guide plate 20 near to the pressure contact part NP is not adjusted to be located at the position closer to the surface of the endless belt 60 than to the surface of the heating roll 50, and when the end part 21*a* is not allowed to come close to the introducing port NPin of the pressure contacts part NP and is located at the position with the same space E1 separated from the introducing port NPin as that in the first adjusting state (for instance, a position at the same height as that of the dashed line L3 of the horizontal line in FIG. 7), a below-described result is obtained.

Namely, since the space between the end part 21*a* of the guide part in the guide plate 20 near to the pressure contact part NP and the introducing port NPin is large (assuming that the end part 21*a* of the guide part is located on the dashed line L3 in the right half part of FIG. 7), the enveloped shaped recording medium 10B may occasionally move so that the end part 10Ba collides against the surface of the endless belt 60. The wrinkles may be generated in the recording medium 10B due to an impact by such a collision or the recording medium 10B may clog before the pressure contact part NP.

Second Exemplary Embodiment

Figure 12:
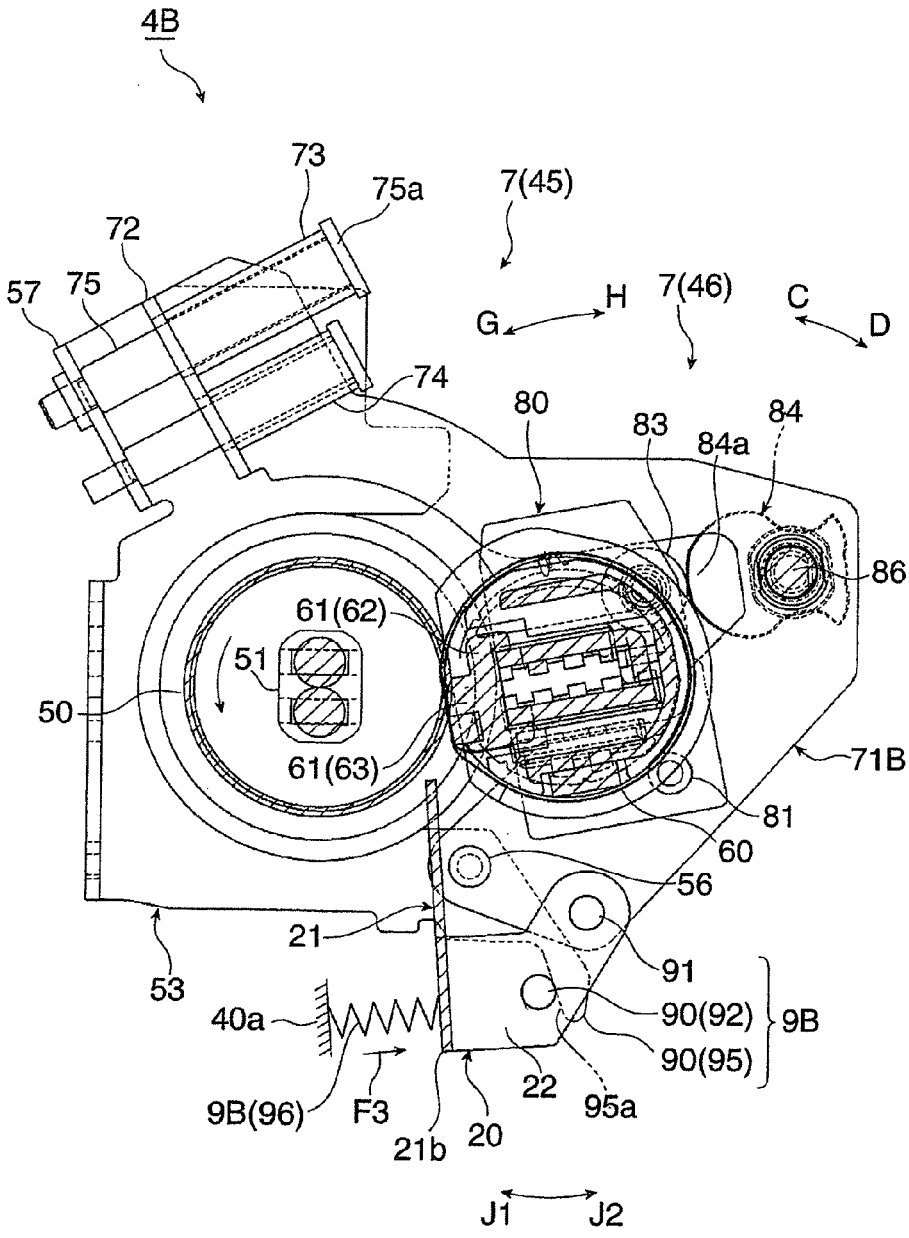
FIG. 12 is a partly sectional view showing a state of a fixing device according to a second exemplary embodiment during an ordinary mode.
Figure 13:
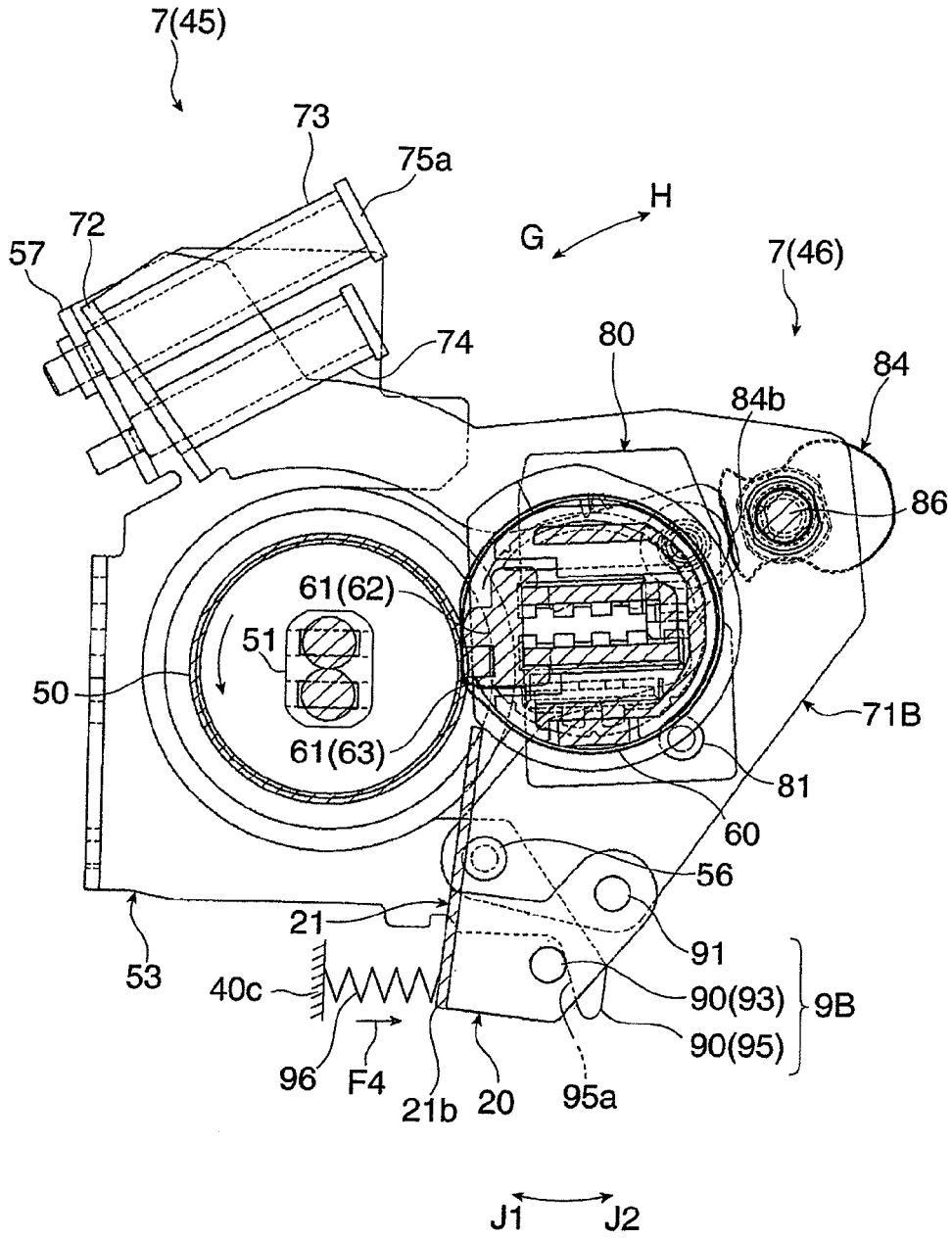
FIG. 13 is a partly sectional view showing a state of the fixing device shown in FIG. 12 during an envelope mode.
Figure 14:
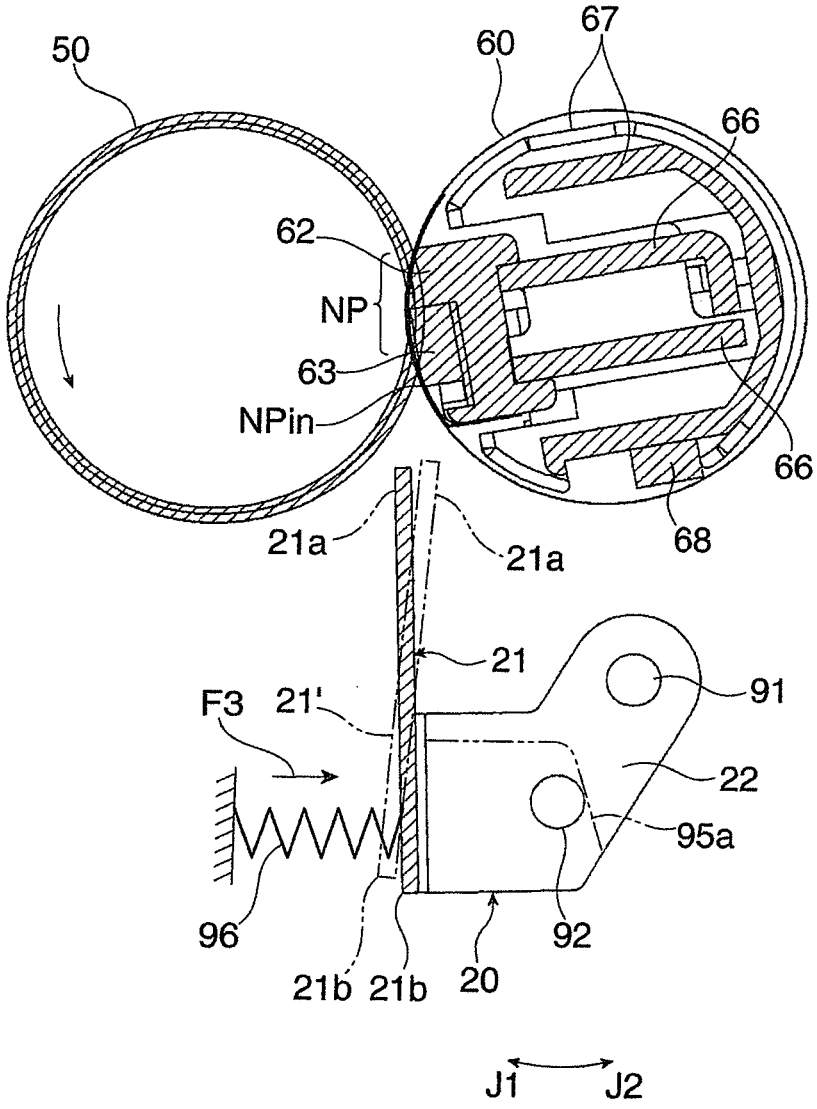
FIG. 14 is a sectional view showing a state of a main part of the fixing device shown in FIG. 12.

FIGS. 12 to 14 show a fixing device 4B according to a second exemplary embodiment of the present invention.

The fixing device 4B has the same structure as that of the fixing device 4 according to the first exemplary embodiment except that a part of the adjusting mechanism 9 is changed. Accordingly, in the specification and the drawings described hereinafter, components common to those of the fixing device 4 according to the first exemplary embodiment are designated by the same reference numerals and an explanation of the common components will be omitted except a case that the explanation is necessary (This is applied to exemplary embodiments described below).

An adjusting mechanism 9B in the second exemplary embodiment uses a stop piece 95 having a guide side part 95*a* with which a protruding pin 92 of an attaching arm part 22 comes into contact in place of the stop slot 94 of the fixed structural part 93 in the stop mechanism 90. Further, the adjusting mechanism 9B uses a compression spring 96 for applying to a guide plate 20 a resilient force F3 for pressing the protruding pin 92 to the guide side part 95*a* of the stop piece 95.

The stop piece 95 is formed by fabricating a configuration in which for instance, the long side part 94*a* of the shaft side (FIG. 8) of the stop slot 94 in the first exemplary embodiment which is formed in the extending part 53*d* of the fixing frame 53 is left as the guide side part 95*a*, other part (at least the long side part 94*b* of the guide part side) forming the stop slot 94 is deleted. The compression spring 96 has its one end fixed to a part 40*a* of a casing 40 and the other end provided so as to press a part of an end part 21*b* of a guide part separated from a pressure contact part NP. The resilient force F3 of the compression spring 96 is set to a pressure so that the guide plate 20 may swing in a direction shown by an arrow mark J2 on a second shaft 91 as a supporting point and the protruding pin 92 may be maintain to a state that the protruding pin 92 continuously comes into contact with the guide side part 95*a* of the stop piece 95 to obtain a first adjusting state during an ordinary mode and a second adjusting state during an envelope mode.

In the fixing device 4B, when the ordinary mode is selected, as shown in FIG. 12, a contact part (a head member 62 and a pad member 63) of a pressing member 61 is displaced to a setting position during an ordinary time by a displacing mechanism 7, and a guide part 21 of the guide plate 20 is adjusted to the first adjusting state by the adjusting mechanism 9B correspondingly thereto.

Namely, in the guide plate 20, the second shaft 91 in an attaching arm part 22 is positioned to a position where a pressurizing and swing frame 71 of a pressurizing mechanism 45 in the displacing mechanism 7 is located in a stationary state and the guide plate 20 is stopped under a state that the protruding pin 92 of the stop mechanism 90 comes into contact with the guide side part 95*a* in the stop piece 95 of the stop mechanism 90. At this time, as shown in FIG. 12 or FIG. 14, the protruding pin 92 is opposed to a lower side position of the guide side part 95*a* of the stop piece 95 so as to come into contact therewith. Further, the resilient force F3 is applied to the protruding pin 92 from the compression spring 96 to maintain a state that the protruding pin 92 is elastically pressed to the guide side part 95*a* of the stop piece 95. Thus, the guide plate 20 is prevented from swinging in the directions shown by the arrow marks J1 and J2 on the second shaft 91. However, the prevention of the guide plate 20 from swinging in the direction shown by the arrow mark J1 is temporarily cancelled when the compression spring 96 is compressed.

Further, in the fixing device 4B, when the envelope mode is selected, as shown in FIG. 13, the contact part (the head member 62 and the pad member 63) of the pressing member 61 is displaced to a setting position during a change by the displacing mechanism 7, and the guide part 21 of the guide plate 20 is adjusted to the second adjusting state by the adjusting mechanism 9B correspondingly thereto.

Namely, in the guide plate 20, the second shaft 91 is positioned to a position where the pressurizing and swing frame 71 of the pressurizing mechanism 45 in the displacing mechanism 7 is swung in the direction shown by an arrow mark C and then located in a stationary state and the guide plate 20 is stopped under a state that the protruding pin 92 of the stop mechanism 90 comes into contact with the guide side part 95*a* in the stop piece 95 of the stop mechanism 90. At this time, as shown in FIG. 13, the protruding pin 92 is opposed to an upper side position of the guide side part 95*a* of the stop piece 95 so as to come into contact therewith. Further, when the end part 21*b* of the guide part separated from the pressure contact part NP is swung in the direction shown by the arrow mark J1 on the second shaft 91 as a supporting point, the compression spring 96 is compressed correspondingly thereto. Thus, a resilient force F4 (>F3) generated from the compressed compression spring 96 is applied to the protruding pin 92 to maintain a state that the protruding pin 92 is elastically pressed to the guide side part 95*a* of the stop piece 95. Thus, the guide plate 20 is prevented from swinging in the directions shown by the arrow marks J1 and J2 on the second shaft 91. However, the prevention of the guide plate 20 from swinging in the direction shown by the arrow mark J1 is temporarily cancelled when the compression spring 96 is compressed.

Then, in the fixing device 4B using the adjusting mechanism 9B, when a thick sheet (a sheet whose basis weight is 160 g/m$^2$ or more) is used as a recording medium 10 during the ordinary mode, below-described advantages are obtained.

Ordinarily, when an end part (a rear end part) of the thick sheet in an upstream side of a transporting direction passes through an end part 21*a* of the guide part in the guide plate 20 near to the pressure contact part NP, the end part 21*a* of the guide part 21 receives such a force as to press the end part 21*a* of the guide part 21 (21') so as to come close to an endless belt 60 due to the firmness of the thick sheet. However, in the fixing device 4B, as shown in FIG. 14, when the end part 21*a* receives the force due to the firmness of the thick sheet, the compression spring 96 is resiliently compressed. Thus, the guide part 21 is swung in the direction shown by the arrow mark J1 on the second shaft 91 as a supporting point and displaced (see a state of the guide part 21 shown by a two-dot chain line). As a result, when the rear end part of the thick sheet passes through the end part 21*a* of the guide part 21, a swing movement (an impact) of the end part 21*a* of the guide part due to a release from the regulation by the guide is reduced, so that a turbulence of an unfixed toner image or the occurrence of abnormal sound is prevented.

In the adjusting mechanism 9B, when a spring member may generate a resilient force for swinging the guide plate 20 in the direction shown by the arrow mark J2 on the second shaft 91 as the supporting point, any of the spring members different in their kinds or places to be arranged may be employed in place of the compression spring 96.

Third Exemplary Embodiment

Figure 15:
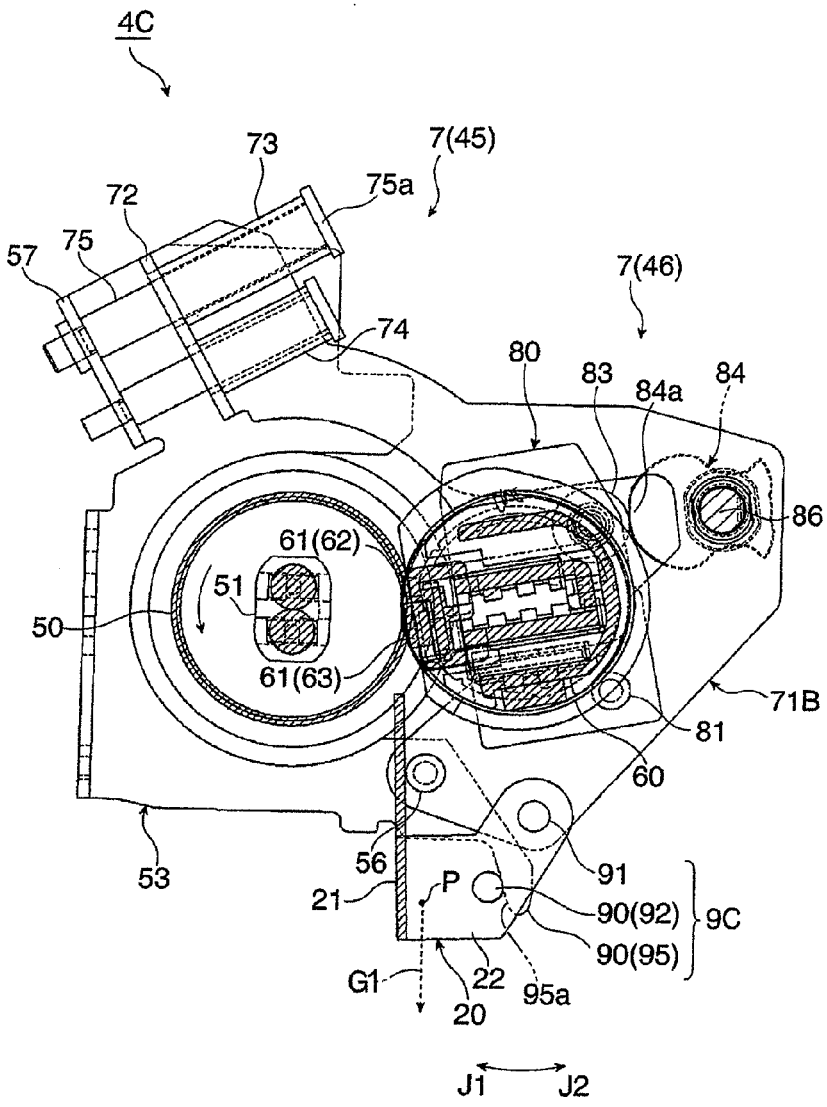
FIG. 15 is a partly sectional view showing a state of a fixing device according to a third exemplary embodiment during an ordinary mode.
Figure 16:
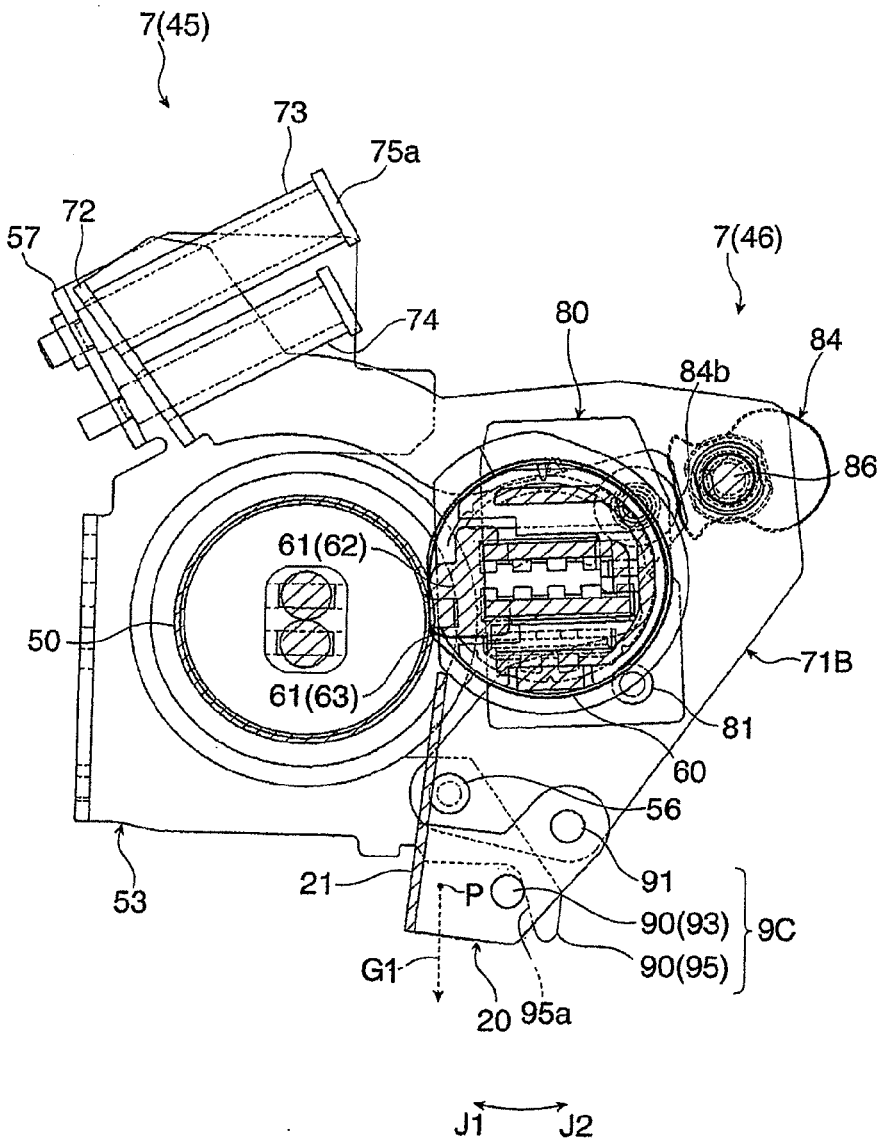
FIG. 16 is a partly sectional view showing a state of the fixing device shown in FIG. 15 during an envelope mode.
Figure 17:
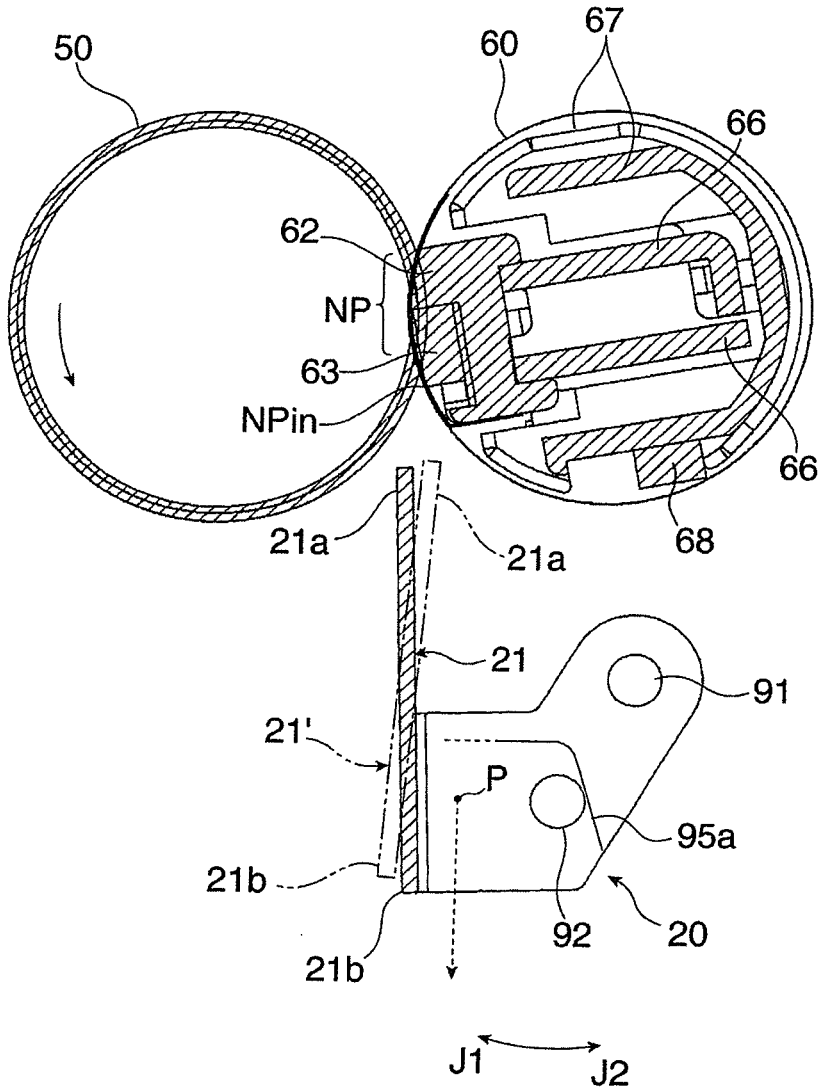
FIG. 17 is a sectional view showing a state of a main part of the fixing device shown in FIG. 15.

FIGS. 15 to 17 show a fixing device 4C according to a third exemplary embodiment of the present invention. The fixing device 4C has the same structure as that of the fixing device 4 according to the first exemplary embodiment except that a part of the adjusting mechanism 9 is changed.

An adjusting mechanism 9C in the third exemplary embodiment uses, similarly to the adjusting mechanism 9B in the second exemplary embodiment, a stop piece 95 having a guide side part 95*a* with which a protruding pin 92 of an attaching arm part 22 comes into contact in place of the stop slot 94 of the fixed structural part 93 in the stop mechanism 90. Further, a guide plate 20 is swung in the direction shown by an arrow mark J2 due to a tare weight to maintain a state that the protruding pin 92 is pressed to the guide side part 95*a* of the stop piece 95.

The guide plate 20 has a structure that a guide part 21 as a main body part thereof is arranged to be biased relative to a second shaft 91. Thus, a center of gravity P is located at a position closer to the guide part 21 than to the second shaft 91. Accordingly, for instance, as shown in FIG. 15, when the guide plate 20 supported by the second shaft 91 receives a gravity G1 with the center of gravity P set at a central part, the guide part 21 as the main body part is apt to move to a lowermost position. Thus, the guide plate 20 is naturally swung in the direction shown by the arrow mark J2 on the second shaft 91 as a supporting point.

In the fixing device 4C, when an ordinary mode is selected, as shown in FIG. 15, a contact part (a head member 62 and a pad member 63) of a pressing member 61 is displaced to a setting position during an ordinary time by a displacing mechanism 7, and the guide part 21 of the guide plate 20 is adjusted to a first adjusting state by the adjusting mechanism 9C correspondingly thereto.

Namely, in the guide plate 20, the second shaft 91 in an attaching arm part 22 is positioned to a position where a pressurizing and swing frame 71 of a pressurizing mechanism 45 in the displacing mechanism 7 is located in a stationary state and the guide plate 20 is stopped under a state that the protruding pin 92 of the stop mechanism 90 comes into contact with the guide side part 95*a* in the stop piece 95 of the stop mechanism 90. At this time, as shown in FIG. 15 or FIG. 17, the protruding pin 92 is opposed to a lower side position of the guide side part 95*a* of the stop piece 95 so as to come into contact therewith. Further, since the guide plate 20 is located in a state that the guide plate 20 is liable to be swung in the direction shown by the arrow mark J2 due to its tare weight, the protruding pin 92 is maintained in a state that the protruding pin 92 is elastically pressed to the guide side part 95*a* of the stop piece 95. Thus, the guide plate 20 is prevented from swinging in the directions shown by the arrow marks J1 and J2 on the second shaft 91 as a supporting point. However, the prevention of the guide plate 20 from swinging in the direction shown by the arrow mark J1 is temporarily cancelled when an external force larger than a force in which the guide plate 20 is apt to be swung in the direction shown by the arrow mark J2 by the gravity G1 is applied to the guide plate 20.

Further, in the fixing device 4C, when the envelope mode is selected, as shown in FIG. 16, the contact part (the head member 62 and the pad member 63) of the pressing member 61 is displaced to a setting position during a change by the displacing mechanism 7, and the guide part 21 of the guide plate 20 is adjusted to the second adjusting state by the adjusting mechanism 9C correspondingly thereto.

Namely, in the guide plate 20, the second shaft 91 is positioned to a position where the pressurizing and swing frame 71 of the pressurizing mechanism 45 in the displacing mechanism 7 is swung in the direction shown by an arrow mark C and then located in a stationary state and the guide plate 20 is stopped under a state that the protruding pin 92 of the stop mechanism 90 comes into contact with the guide side part 95*a* in the stop piece 95 of the stop mechanism 90. At this time, as shown in FIG. 16, the protruding pin 92 is opposed to an upper side position of the guide side part 95*a* of the stop piece 95 so as to come into contact therewith. Further, since the guide plate 20 is located in a state that the guide plate 20 is liable to be swung in the direction shown by the arrow mark J2 due to its tare weight, the protruding pin 92 is maintained in a state that the protruding pin 92 is elastically pressed to the guide side part 95*a* of the stop piece 95. Thus, the guide plate 20 is prevented from swinging in the directions shown by the arrow marks J1 and J2 on the second shaft 91 as a supporting point. However, the prevention of the guide plate 20 from swinging in the direction shown by the arrow mark J1 is temporarily cancelled when an external force larger than a force in which the guide plate 20 is apt to be swung in the direction shown by the arrow mark J2 by the gravity G is applied to the guide plate 20.

Then, in the fixing device 4C using the adjusting mechanism 9C, when a thick sheet is used as a recording medium 10 during an ordinary mode, below-described advantages are obtained.

Specifically, in the fixing device 4C, when a rear end part of the thick sheet in an upstream side of a transporting direction passes through an end part 21*a* of the guide part 21 in the guide plate 20 near to a pressure contact part NP, the end part 21*a* of the guide part 21 receives such a force as to press the end part 21*a* of the guide part 21 so as to come close to an endless belt 60 due to the firmness of the thick sheet. However, as shown in FIG. 17, when the force due to the firmness of the thick sheet is larger than the force in which the guide plate 20 is apt to be swung in the direction shown by the arrow mark J2 by the tare weight of the guide plate 20, the guide part 21 is swung in the direction shown by the arrow mark J1 on the second shaft 91 as a supporting point and displaced (see a state of the guide part 21 shown by a two-dot chain line). As a result, when the rear end part of the thick sheet passes through the end part 21*a* of the guide part 21, a swing movement of the end part 21*a* of the guide part due to a release from the regulation by the guide is reduced, so that a turbulence of an unfixed toner image or the occurrence of abnormal sound is prevented.

Fourth Exemplary Embodiment

Figure 18:
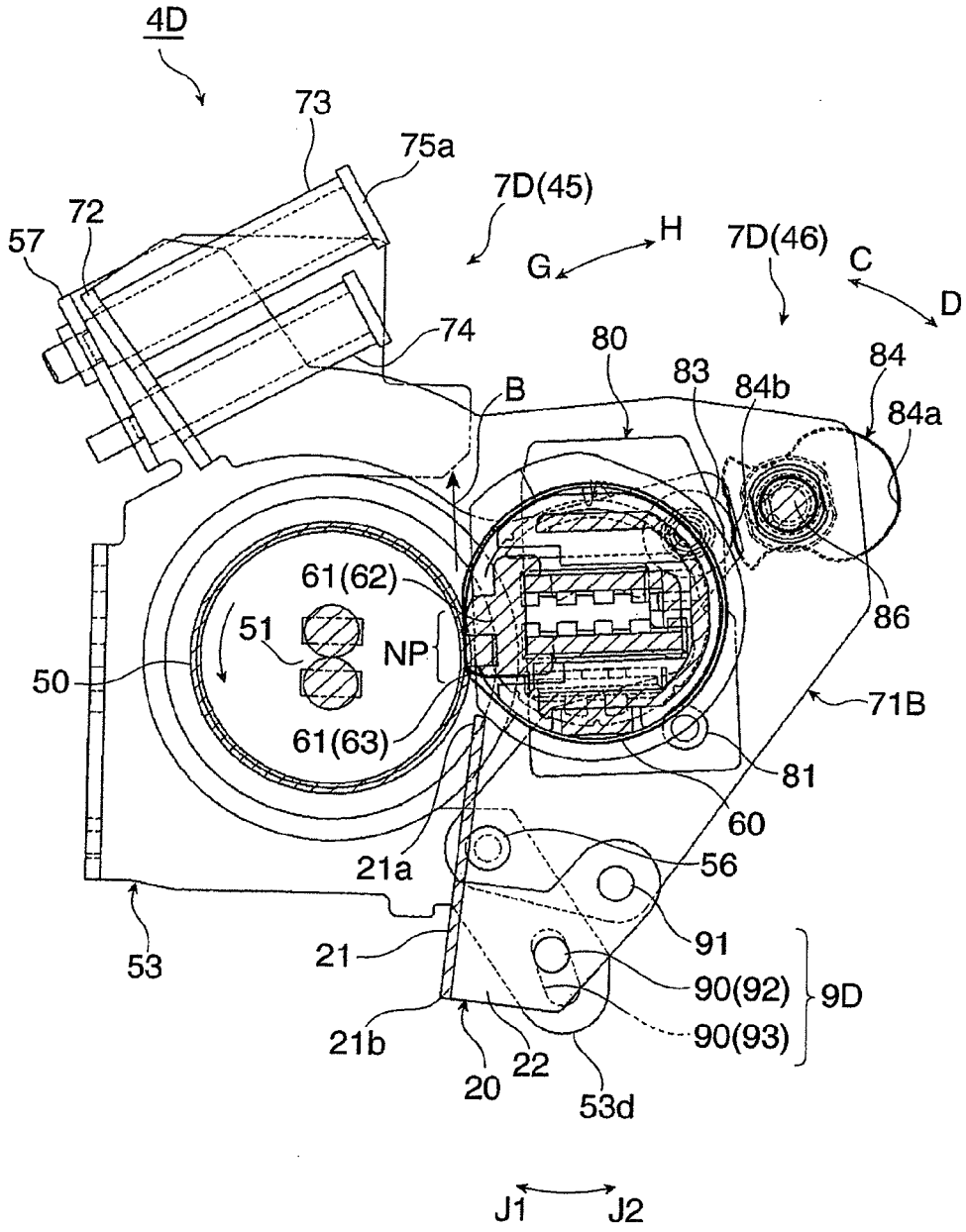
FIG. 18 is a partly sectional view showing a state of a fixing device according to a fourth exemplary embodiment during an ordinary mode.
Figure 19:
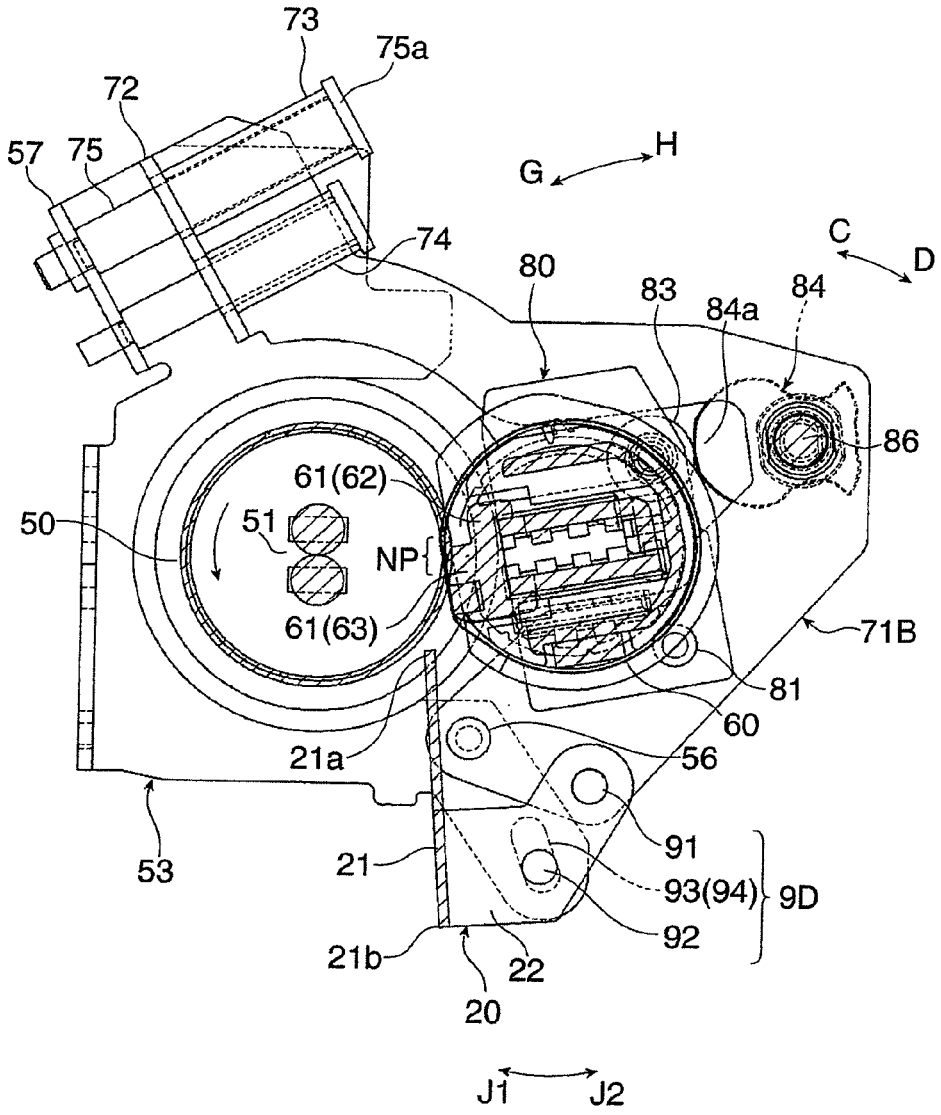
FIG. 19 is a partly sectional view showing a state of the fixing device shown in FIG. 18 during a thin sheet mode.

FIGS. 18 to 19 show a fixing device 4D according to a fourth exemplary embodiment of the present invention. The fixing device 4D has the same structure as that of the fixing device 4 according to the first exemplary embodiment except that a displacing state by the displacing mechanism 7 and an adjusting state by the adjusting mechanism are partly changed.

A displacing mechanism 7D in the fourth exemplary embodiment sets, as a setting position during an ordinary time, a position where both a head member 62 and a pad member 63 of a pressing member 61 come into contact with a heating roll 50 through an endless belt 60 (FIG. 18). Further, as a setting position during a change, the displacing mechanism sets a position (a second setting position during a change) where only the head member 62 of the pressing member 61 comes into contact with the heating roll 50 through the endless belt 60 by swinging a swing and holding plate 80 in the direction shown by an arrow mark G to displace a contact part of the pressing member 61 to an upstream side of a passing direction B of an object to be fixed (FIG. 19).

Owing to below-described reasons, the displacing mechanism 7D sets the setting positions respectively. Initially, the setting position during the ordinary time is set from the viewpoint that a pressure contact part NP is formed in which a suitable fixing process may be carried out when an ordinary sheet and a thick sheet are used as a recording medium 10. As such a pressure contact part NP, for instance, is exemplified a pressure contact part whose pressure is low and whose width is large. In the fixing device 4D, a fixing state at this time is designated as "an ordinary mode". Further, the setting position during the change is set from the viewpoint that a pressure contact part NP is formed in which a suitable fixing process may be carried out when a thin sheet (a sheet whose basis weight has a value of 160 g/m$^2$ or smaller) is used as the recording medium 10. As such a pressure contact part NP, for instance, is exemplified a pressure contact part whose pressure is high and whose width is small. In the fixing device 4D, a fixing state at this time is designated as "a thin sheet mode".

A pressurizing mechanism 45 and a changing and switching mechanism 46 forming the displacing mechanism 7D have the same structures of the displacing mechanism 7 in the first exemplary embodiment except below-described points. Initially, a change cam 84 is formed in such a way that when the contact part is displaced to the setting position during the change (at the time of selection during the ordinary mode), a first cam surface 84*a* is used, and when the setting position is changed to the setting position during the ordinary time (at the time of selection during the thin sheet mode), a second cam surface 84*b* is used. In accordance with the change of the displacing state by the displacing mechanism 7D, the head member 62 and the pad member 63 of the pressing member 61 are arranged at positions shifted more in the upstream side of the passing direction B of the object to be fixed than those of the head member 62 and the pad member 63 in the first exemplary embodiment, and the dimensions of the members 62 and 63 in the passing direction B are respectively diminished. Compression springs 73 and 74 are used that are higher in their loads and lower in their spring constants than those of the springs 73 and 74 in the first exemplary embodiment.

Further, when the setting position is changed to the setting position during the ordinary time by the displacing mechanism 7D (during the selection of the ordinary mode), an adjusting mechanism 9D of the fourth exemplary embodiment is set to adjust a guide part to the above-described second adjusting state. When the setting position is changed to the setting position during the change (during the selection of the thin sheet mode), the adjusting mechanism 9D is set to adjust a guide part to the above-described first adjusting state. In this case, the structure of the adjusting mechanism 9D is the same as that of the adjusting mechanism 9 (the structure using the second shaft 91 and the stop mechanism 90) in the first exemplary embodiment.

In the fixing device 4, when the ordinary mode is selected, as shown in FIG. 18, the contact part (the head member 62 and the pad member 63) of the pressing member 61 is displaced to the setting position during the ordinary time by the displacing mechanism 7D, a guide part 21 of a guide plate 20 is adjusted to the second adjusting state by the adjusting mechanism 9D correspondingly thereto.

Initially, in the setting position during the ordinary time, the second cam surface 84*b* of the change cam 84 comes into contact with a cam receiving member 83. Thus, the compression springs 73 and 74 are extended to weaken a resilient force, so that a pressurizing and swing frame 71 is swung in the direction shown by an arrow mark C on a first shaft 56 as a supporting point, and accordingly, the swing and holding plate 80 is swung in the direction shown by an arrow mark H on a shaft 81 as a supporting point. As a result, both the head member 62 and the pad member 63 in the pressing member 61 are opposed to the heating roll 50 so as to come into contact with the heating roll 50.

When the contact part of the pressing member 61 is displaced to the setting position during the ordinary time, in the guide plate 20, the second shaft 91 in an attaching arm part 22 is positioned to a position where the pressurizing and swing frame 71 of the pressurizing mechanism 45 in the displacing mechanism 7D is located in a stationary state. Further, the guide plate 20 is stopped under a state that a protruding pin 92 of the stop mechanism 90 is opposed respectively to upper side positions of a long side part 94*a* of a shaft side and a long side part 94*b* of a guide part side (FIG. 11) in a stop slot 94 of the stop mechanism 90 so as to come into contact therewith. Thus, the guide plate 20 is prevented from swinging in the directions shown by arrow marks J1 and J2 on the second shaft 91 as a supporting point.

As a result, as shown in FIG. 18, the guide plate 20 is set to the second adjusting state in which an end part 21*a* of the guide part 21 near to a pressure contact part NP is located at a position closer to the surface of the endless belt 60 than to the surface of the heating roll 50 and near (a space E2) to an introducing port NPin of the pressure contact part NP (see the contents shown in the right half part of FIG. 7). At this time, an end part 21*b* of the guide plate 20 separated from the pressure contact part NP is located in an arranging area of the heating roll 50. Further, a guide surface 21*c* of the guide part 21 is generally in a state of moving forward to the surface of the endless belt 60 and the end part 21*a* comes near to the pressure contact part NP.

In the ordinary mode, when the recording medium 10 such as the ordinary sheet or the thick sheet is guided to the introducing port NPin of the pressure contact part NP by the guide plate 20 in the second adjusting state. Namely, in the recording medium 10 at this time, an end part 10*a* in a downstream side of a transporting direction is moved in contact with the guide surface 21*c* of the guide part 21 in the guide plate 20, and finally guided by the end part 21*a* near to the pressure contact part NP to enter the introducing port NPin. Specifically, the end part 10*a* of the recording medium 10 is guided by the end part 21*a* of the guide part located at a position separated from the heating roll 50 to move forward in a state close to the surface of the endless belt 60 and finally reaches rapidly the introducing port NPin of the pressure contact part NP just before the end part 10*a* of the recording medium 10 to be introduced therein.

Especially, when the recording medium 10 is the thick sheet, since the end part 21*a* of the guide part is arranged at a position that is not close to the surface of the heating roll 50 and close to the surface of the endless belt 60, if a rear end part of the thick sheet passes through the end part 21*a* of the guide part, a violent swing movement thereof does not occur. Thus, a turbulence of an image or a clogging of the recording medium due to such a movement does not occur.

Then, in the fixing device 4D, when the thin sheet mode is selected, as shown in FIG. 19, the contact part (the head member 62 and the pad member 63) of the pressing member 61 is displaced to the setting position during the change by the displacing mechanism 7D, the guide part 21 of the guide plate 20 is adjusted to the first adjusting state by the adjusting mechanism 9D correspondingly thereto.

Initially, in the setting position during the change, the first cam surface 84*a* of the change cam 84 comes into contact with the cam receiving member 83. Thus, the compression springs 73 and 74 are compressed to increase the resilient force, so that the pressurizing and swing frame 71 is swung in the direction shown by an arrow mark D on the first shaft 56 as the supporting point, and accordingly, the swing and holding plate 80 is swung in the direction shown by an arrow mark G on the shaft 81 as the supporting point. As a result, only the head member 62 in the pressing member 61 is opposed to the heating roll 50 so as to come into contact with the heating roll 50.

When the contact part of the pressing member 61 is displaced to the setting position during the change, in the guide plate 20, the second shaft 91 is positioned to a position where the pressurizing and swing frame 71 in the displacing mechanism 7D is swung in the direction shown by the arrow mark D and then located in a stationary state. Further, the guide plate 20 is stopped under a state that the protruding pin 92 of the stop mechanism 90 is opposed respectively to lower side positions of the long side part 94*a* of the shaft side and the long side part 94*b* of the guide part side (FIG. 8) in the stop slot 94 of the stop mechanism 90 so as to come into contact therewith. Thus, the guide plate 20 is prevented from swinging in the directions shown by the arrow marks J1 and J2 on the second shaft 91 as the supporting point.

As a result, as shown in FIG. 19, the guide plate 20 is set to the first adjusting state in which the end part 21*a* of the guide part 21 near to the pressure contact part NP is located at a position closer to the surface of the heating roll 50 than to the surface of the endless belt 60 and a prescribed space E1 separated from the introducing port NPin of the pressure contact part NP (see the contents shown in the left half part of FIG. 7). At this time, the end part 21*b* of the guide plate 20 separated from the pressure contact part NP is located in the arranging area of the heating roll 50. Further, the guide surface 21*c* of the guide part 21 is generally in a state of moving forward to the surface of the heating roll 50 and the end part 21*a* is separated more from the pressure contact part NP than in the ordinary mode.

In the thin sheet mode, when the recording medium 10 of a thin sheet is guided to the introducing port NPin of the pressure contact part NP by the guide plate 20 in the first adjusting state. Namely, in the recording medium 10 of the thin sheet at this time, an end part 10*a* in the downstream side of a transporting direction is moved in contact with the guide surface 21*c* of the guide part 21, and finally guided by the end part 21*a* near to the pressure contact part NP to enter the introducing port NPin. Specifically, the end part 10*a* of the recording medium 10 is guided by the end part 21*a* of the guide part to move forward in a state close to the surface of the heating roll 50 and finally moved by the space E1 to be introduced to the introducing port NPin of the pressure contact part NP.

Further, in the thin sheet mode, since the pressure contact part NP is a narrow pressure contact part with which only the head member 62 receiving the increased pressure from the pressurizing and swing frame 71 comes into contact, after the recording medium 10 of the thin sheet passes through the pressure contact part NP, the recording medium is effectively peeled off from the surface of the heating roll 50. Further, even when the recording medium 10 is the thin sheet which includes water and is wavy, after such a recording medium 10 passes through the end part 21*a* of the guide part of the guide plate 20 in a state close to the surface of the heating roll 50, the recording medium 10 is moved to be introduced to the pressure contact part NP under a state that the recording medium is bent so as to be slightly warped. As a result, even in the wavy thin sheet including water, when the thin sheet passes through the end part 21*a* of the guide part, the thin sheet is moved under a state that the thin sheet is strongly pressed thereby. Thus, the wavy part of the thin sheet is remedied (canceled) and the thin sheet is introduced to the pressure contact part NP, so that a fixing process may be realized without generating wrinkles.

For reference, when the wavy thin sheet including water is allowed to pass the guide plate 20 in the second adjusting state during the ordinary mode to carry out the fixing process, a below-described result is obtained.

Namely, since the wavy part of the wavy thin sheet including water passes through the end part 21*a* of the guide part in a position close to the surface of the endless belt 60, the wavy part is not strongly pressed by the end part 21*a* and then introduced to the pressure contact part NP as in the case of passing through the end part 21*a* of the guide part 21 of the guide plate 20 in the first adjusting state. Therefore, the thin sheet is introduced to the pressure contact part NP with the wavy part of the thin sheet left as it is. Consequently, the wrinkles are generated during the fixing process.

Other Exemplary Embodiments

In the first to fourth exemplary embodiments, as the pressing rotating member 6, a belt type formed with the endless belt 60 and the pressing member 61 is exemplified, however, a roll type may be applied to the pressing rotating member. In this case, the roll shaped pressing rotating member 6 may have a roll structure including an elastic layer and the pressing roll may be displaced to the setting position during the ordinary time and the setting position during the change by the displacing mechanism 7.

For instance, in the pressurizing and swing frame 71 in the first exemplary embodiment, the pressing roll is held so as to freely rotate through the swing and holding plate 80 and a contact part of the pressing roll with the heating roll 50 is displaced to the downstream side or the upstream side of the passing direction B of the object to be fixed by the cam operation of the change cam 84. Namely, as shown in FIGS. 4, 7 and 9, the endless belt 60 may be taken as a peripheral surface of the pressing roll. In this structure, the contact part of the pressing roll with the heating roll 50 corresponds to the pressure contact part NP. However, depending on the level of the pressure applied from the pressurizing and swing frame 71, a degree of deformation of the elastic layer of the pressing roll is changed, so that a width of the pressure contact part NP along the passing direction B is also increased or decreased. In accordance with the displacement of the pressing roll by the displacing mechanism 7, the state of the guide plate 20 may be adjusted to a more suitable state by the adjusting mechanism 9.

Further, as the pressing member 61 in the pressing rotating member 6, the pressing member is exemplified which is formed with the head member 62 of the inelastic member and the pad member 63 of the elastic member. However, the pressing member is not limited to this structure. For instance, a pressing member formed with either the head member 62 or the pad member 63 may be employed.

Further, as the pressurizing mechanism 45 in the displacing mechanism 7, one or three or more compression coil springs may be employed. The pressurizing mechanism 45 may be formed by using a spring such as a plate shaped compression spring in place of the compression coil spring.

As for the fixing device 4, as the fixing rotating member 5, a fixing roll that does not include the heating device 51 may be employed in place of the heating roll 50. Further, as the pressing member 61 of the pressing rotating member 6, a pressing heating member having a heating unit may be employed. As a heating unit of the pressing member 61, when for instance, an electro-magnetic type heating unit is employed, an endless belt having an electrically conductive layer may be used as the endless belt 60. Further, when the pressing rotating member 6 is formed as the roll type, a rotating member of a belt type may be employed as the fixing rotating member 5.

Additionally, as the image creating device 2 in the image forming device 1, an image creating device of a type may be employed in which toner images of plural of colors are formed and respectively transferred to the recording medium 10 to form a multi-color image. In a transfer system in the image creating device 2, a well-known intermediate transfer system may be employed in place of a direct transfer system.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing rotating member having a fixing surface with which a recording medium holding an unfixed image comes into contact;

a pressing rotating member pressed to the fixing surface of the fixing rotating member to form a fixing process part between the pressing rotating member and the fixing surface through which the recording medium to pass;

a displacing mechanism that can displace the pressing rotating member at least at a first setting position that the pressing rotating member pressed to the fixing surface is located in a first position relative to the fixing rotating member and at a second setting position that the pressing rotating member pressed to the fixing surface is in a second position shifted from the first position in the downstream side or the upstream side of a passing direction of the recording medium at the fixing process part;

a guide member having a guide part that guides the recording medium to an introducing portion of the fixing process part between the fixing rotating member and the pressing rotating member;

an adjusting mechanism that can adjust the position of the guide member in accordance with the displacement of the pressing rotating member at least to the first setting position or the second setting position by the displacing mechanism, wherein the adjusting mechanism adjusts an end of the guide part in the guide member near to the fixing process part to be located in a first state in which the end of the guide part is located at a position closer to the fixing surface of the fixing rotating member than to the surface of the pressing rotating member and a prescribed space separated from the introducing area of the fixing process part and in a second state in which the end of the guide part is located at a position closer to the surface of the pressing rotating member than to the fixing surface of fixing rotating member and nearer to the introducing portion of the fixing process part than in the first state.

2. An image forming device comprising:

an image creating device that forms an unfixed image and transfers the image to a recording medium; and a fixing device that fixes the unfixed image transferred in the image creating device in the recording medium, wherein the fixing device is the fixing device according to claim 1.

3. A fixing device comprising:

a fixing rotating member having a fixing surface with which a recording medium holding an unfixed image comes into contact;

a pressing rotating member pressed to the fixing surface of the fixing rotating member to form a fixing process part between the pressing rotating member and the fixing surface through which the recording medium to pass;

a displacing mechanism that can displace the pressing rotating member at least at a first setting position that the pressing rotating member pressed to the fixing surface is located in a first position relative to the fixing rotating member and at a second setting position that the pressing rotating member pressed to the fixing surface is in a second position shifted from the first position in the downstream side or the upstream side of a passing direction of the recording medium at the fixing process part;

a guide member having a guide part that guides the recording medium to an introducing portion of the fixing process part between the fixing rotating member and the pressing rotating member;

an adjusting mechanism that can adjust the position of the guide member in accordance with the displacement of the pressing rotating member at least to the first setting position or the second setting position by the displacing mechanism, wherein the adjusting mechanism adjusts an end of the guide part in the guide member near to the fixing process part to be located in a first state in which the end of the guide part is located at a position closer to the fixing surface of the fixing rotating member than to the surface of the pressing rotating member and a prescribed space separated from the introducing area of the fixing process part or in a second state in which the end of the guide part is located at a position closer to the surface of the pressing rotating member than to the fixing surface of fixing rotating member and nearer to the introducing portion of the fixing process part than in the first state, and wherein the displacing mechanism includes a movable member that is arranged to swing around a first shaft arranged in a position of an introducing area side of the recording medium in the fixing process part so as to be able to come close to and separate from the fixing rotating member, the movable member supporting the pressing rotating member so as to be able to be displaced at least to the first setting position and the second setting position, and the adjusting mechanism attaches the guide member to the movable member so as to swing around a second shaft, the adjusting member further including a stopper stopping the guide member from swinging together with the swing movement of the movable member at positions respectively for holding the guide member in the first state and the second state.

4. The fixing device according to claim 3, wherein the stopper includes a protrusion provided in the guide member and a structure fixing part having a contact part with which the protrusion comes into contact to prevent the guide member from swinging.

5. The fixing device according to claim 4, wherein the stopper is configured so that the contact part of the structural fixing part prevents the end of the guide member near to the fixing process part from swinging close to the fixing rotating member but permits the end of the guide member to swing apart from the fixing rotating member, the stopper further including a spring member for applying a resilient force for maintaining a state that the guide member swings around the second shaft and the protrusion comes into contact with the contact part of the fixed structural part.

6. The fixing device according to claim 4, wherein the stopper is configured that the contact part of the structural fixing part prevents the end of the guide member near to the fixing process part from swinging close to the fixing rotating member but permits the end of the guide member to swing apart from the fixing rotating member, and is formed to maintain a state that the guide member swings around the second shaft due to a gravity so that the protrusion comes into contact with the contact part of the structural fixing part.

* * * * *